US008826918B2

(12) United States Patent
Hornbach et al.

(10) Patent No.: US 8,826,918 B2
(45) Date of Patent: Sep. 9, 2014

(54) START, STYLE, AND FINISH HAIRSTYLING SYSTEM

(75) Inventors: Angela Marie Hornbach, Atlanta, GA (US); Christopher Davis, Atlanta, GA (US)

(73) Assignee: Goody Products, Inc., Atlanta, GA (US)

( * ) Notice: Subject to any disclaimer, the term of this patent is extended or adjusted under 35 U.S.C. 154(b) by 1311 days.

(21) Appl. No.: 11/935,890

(22) Filed: Nov. 6, 2007

(65) Prior Publication Data

US 2009/0114238 A1 May 7, 2009

Related U.S. Application Data

(60) Provisional application No. 60/984,676, filed on Nov. 1, 2007.

(51) Int. Cl.

| | |
|---|---|
| ***A45D 24/00*** | (2006.01) |
| ***A45D 44/02*** | (2006.01) |
| ***A46B 15/00*** | (2006.01) |
| *A45D 44/00* | (2006.01) |
| *A45D 7/00* | (2006.01) |

(52) U.S. Cl.

CPC ..... *A45D 44/02* (2013.01); *A45D 44/005* (2013.01); *A45D 7/00* (2013.01); *A46B 15/0091* (2013.01); *A46B 15/0085* (2013.01); *A45D 24/00* (2013.01); *A46B 2200/104* (2013.01)

USPC ..... 132/200

(58) Field of Classification Search

USPC ..... 132/207, 200, 261, 148, 126; 434/94

See application file for complete search history.

(56) References Cited

U.S. PATENT DOCUMENTS

| | | | | |
|---|---|---|---|---|
| 4,299,240 | A | 11/1981 | Failing | |
| 4,407,309 | A | 10/1983 | McFarland | |
| 5,797,755 | A * | 8/1998 | Montgomery | 434/429 |
| 6,994,097 | B1 | 2/2006 | Palmeri | |

OTHER PUBLICATIONS http://web.archive.org/web/20050320112446/http://www.hair-styles-secrets-revealed.com/hair+brush.htm.* http://web.archive.org/web/20070522141654/http://www.ehow.com/how_2026031_style-long-hair.html.* http://web.archive.org/web/20050320112024/http://www.hair-styles-secrets-revealed.com/curly+hair+style.htm.* http://web.archive.org/web/20060506171339/http://www.hairfinder. com/hairquestions/smooth_shiny_hair.htm.*

Sephora.com; Jonathan Products & Jonathan Hair Products at Sephora.com; website; date unknown; 4 pages; sephora.com/browse/brand_hierarachy.jhtml?/brandId=Jonathan%20Product &contentId=C13541.

Jonathanproduct.com; Home page—Jonathan Products; website; date unknown; 5 pages; jonathanproduct.com/about.html.

Matrix.com; Amplify 4-Step Volumizing System; website; date unknown; 1 page; matrix.com/products/amplify/shampoo.aspx.

* cited by examiner

*Primary Examiner* — Todd Manahan
*Assistant Examiner* — Brianne Kalach
(74) *Attorney, Agent, or Firm* — Lempia Summerfield Katz LLC

(57) ABSTRACT

A first method of systematizing hairstyling tools includes defining hairstyling steps, defining indicia for the steps, determining hairstyling tools to perform the steps, and displaying the indicia on the corresponding tools. A second method of systematizing hairstyling tools includes additionally defining hairstyles, selecting the hairstyling steps to implement the hairstyle, and packaging the corresponding hairstyling tools together as a set. Also within the scope of the invention are hairstyling tools, sets of hairstyling tools, and systems of hairstyling tools according to the first and second methods.

12 Claims, 26 Drawing Sheets

START, STYLE, AND FINISH HAIRSTYLING SYSTEM

CROSS-REFERENCE TO RELATED APPLICATION

This application claims the priority benefit of U.S. Provisional Patent Application Ser. No. 60/984,676, filed Nov. 1, 2007, the entire scope and content of which is hereby incorporated herein by reference.

TECHNICAL FIELD

The present invention relates generally to hair styling tools and methods and, in particular, to an organized system of pre-defined styling steps and styling tools specially adapted for each of the steps.

BACKGROUND OF THE INVENTION

Many women would like, every day of the week, to look like they just stepped out of the hair salon. But most women have trouble recreating their salon hairstyle at home. Sometimes this is because they do not have the proper hair styling tools (brushes, combs, rollers, clips, etc.). And sometimes it is because they do not know which hair styling tools are the correct ones for them, or how or when to use those tools properly. In particular, many women do not know which brushes to use for what effects (e.g., detangling versus smoothing), and even those that do still sometimes do not really know how or when to properly use the brushes.

Accordingly, it can be seen that a need exists for a way to help women know which hair styling tools are right for them as well as how and when to use those tools. It is to the provision of solutions to these and other problems that the present invention is primarily directed.

SUMMARY OF THE INVENTION

Generally described, the present invention provides methods and systems of hairstyling tools that enable women to style their hair at home and get a more salon-like look. In one aspect, the invention includes a first method of systematizing hairstyling tools including defining hairstyling steps, defining indicia for the steps, determining hairstyling tools to perform the steps, and displaying the indicia on the corresponding tools. In an example embodiment according to the first method, there is provided a hairstyling system of "start," "style," and "finish" hairstyling tools, the tools selected for use in corresponding start, style, and finish hairstyling steps, and the tools having corresponding start, style, and finish indicia displayed with them. The start step involves using the proper start tools to properly detangle and dry hair. The style step involves using the proper style tools to properly add volume and straighten or curl to hair. And the finish step involves using the proper finish tools to properly smooth and shine hair.

In another aspect, the invention includes a second method of systematizing hairstyling tools that includes the first method and also includes defining hairstyles, selecting the hairstyling steps to implement the hairstyle, selecting the hairstyling tools to perform the hairstyling steps, and packaging the corresponding hairstyling tools together as a set. In example embodiments according to the second method, there are provided sets of hairstyling tools, including start, style, and finish hairstyling tools, for creating a "volume and straight" style, a "volume and curl" style, and a "volume and smooth" style. Also within the scope of the invention are hairstyling tools, sets of hairstyling tools, and systems of hairstyling tools according to the first and second methods.

The specific techniques and structures employed by the invention to improve over the drawbacks of the prior systems and methods and accomplish the advantages described herein will become apparent from the following detailed description of the example embodiments of the invention and the appended drawings and claims.

DETAILED DESCRIPTION OF EXAMPLE EMBODIMENTS OF THE INVENTION

The present invention provides a system of hairstyling tools that can be used by women at home to create better hair styling results, perhaps even salon-like results. In some embodiments, the system includes conventional hairstyling tools such as brushes and combs only. In other embodiments, the system includes conventional hairstyling tools such as brushes, combs, hair accessories, and electric devices. And in still other embodiments, the system includes any and all conventional hairstyling tools such as brushes, combs, hair accessories, electric devices, wet goods, etc. that are typically sold at retail outlets. Such conventional hairstyling tools are sold under the "I/M BEAUTY" and "GOODY" trademarks by Goody Products, Inc. (Atlanta, Ga.). The present invention can also be adapted for use with other beauty products. Advantageously, the system allows users, whether women or men, to find the correct hairstyling tools for their particular hair type and the specific hairstyle they desire, and teaches them how and when to use those hairstyling tools.

Figure 1:
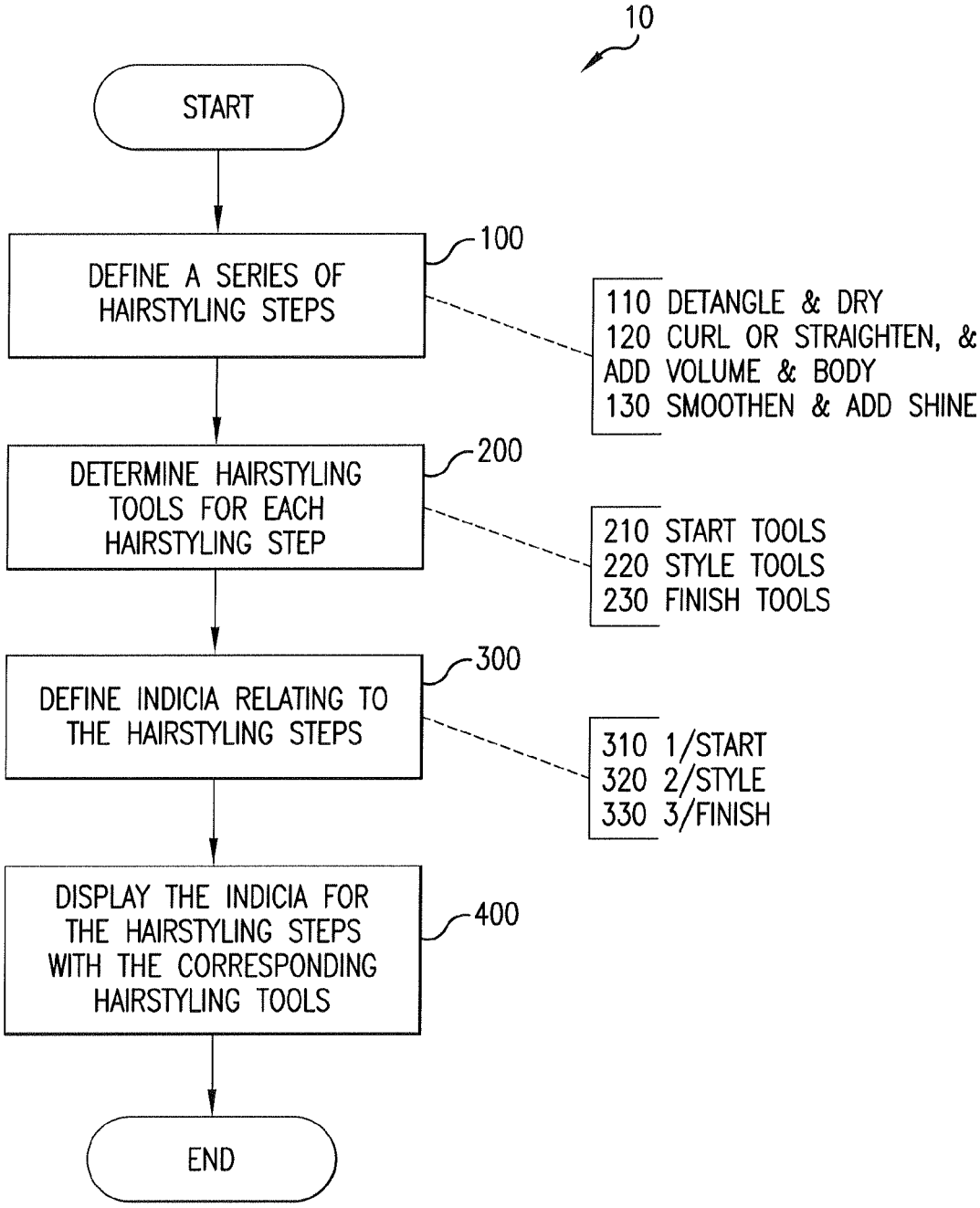
FIG. 1 is a flow diagram of a first example method of systematizing hairstyling tools according to the present invention.

In one aspect of the invention, there is provided a first method of systematizing the hairstyling tools. Referring to FIG. 1, there is shown one such example method 10 according to the present invention. The method 10 includes at step 100 defining a series of hairstyling steps. For example, step 100 may include defining first, second, and third hairstyling steps. The first hairstyling step 110 may include detangling and drying. This is a good starting step for most hairstyles, and generally includes combing or brushing hair when wet. The second hairstyling step 120 may include curling, straightening, adding volume and body, or a combination thereof. In this styling step, the individual look desired is mostly created, and a blow dryer (or other heating device) is typically used. And the third hairstyling step 130 may include smoothening and adding shine. This finishing step typically includes brushing to smoothen out the hair after styling and/or includes gently and evenly distributing natural oils throughout the hair. Alternatively, step 100 may include defining more or fewer than three hairstyling steps and/or defining other hairstyling techniques (and using other names for the same techniques) whether in combination with one or more of the hairstyling steps 110, 120, 130 or without any of them. In addition, each of the example hairstyling steps 110, 120, 130 includes the use of at least one conventional hairstyling tool, though hairstyling steps can be selected that do not include the use of any hairstyling tools, that each include the use of multiple hairstyling tools, or that include the use of a same hairstyling tool as is used in another of the hairstyling steps.

Next, the method 10 includes at step 200 determining which of the hairstyling steps each of the hairstyling tools are suitable for use in. Using the example hairstyling steps described above, FIGS. 2A-C show brushes 210, 220, 230 that are suitable for use in each of the hairstyling steps 110, 120, 130, respectively. The brushes shown and described are typical of those than can be used in the method 10 and are included for illustrative purposes only. Preferably, these brushes have gel handles for comfort and include infused ceramic and tourmaline portions.

Figure 2A:
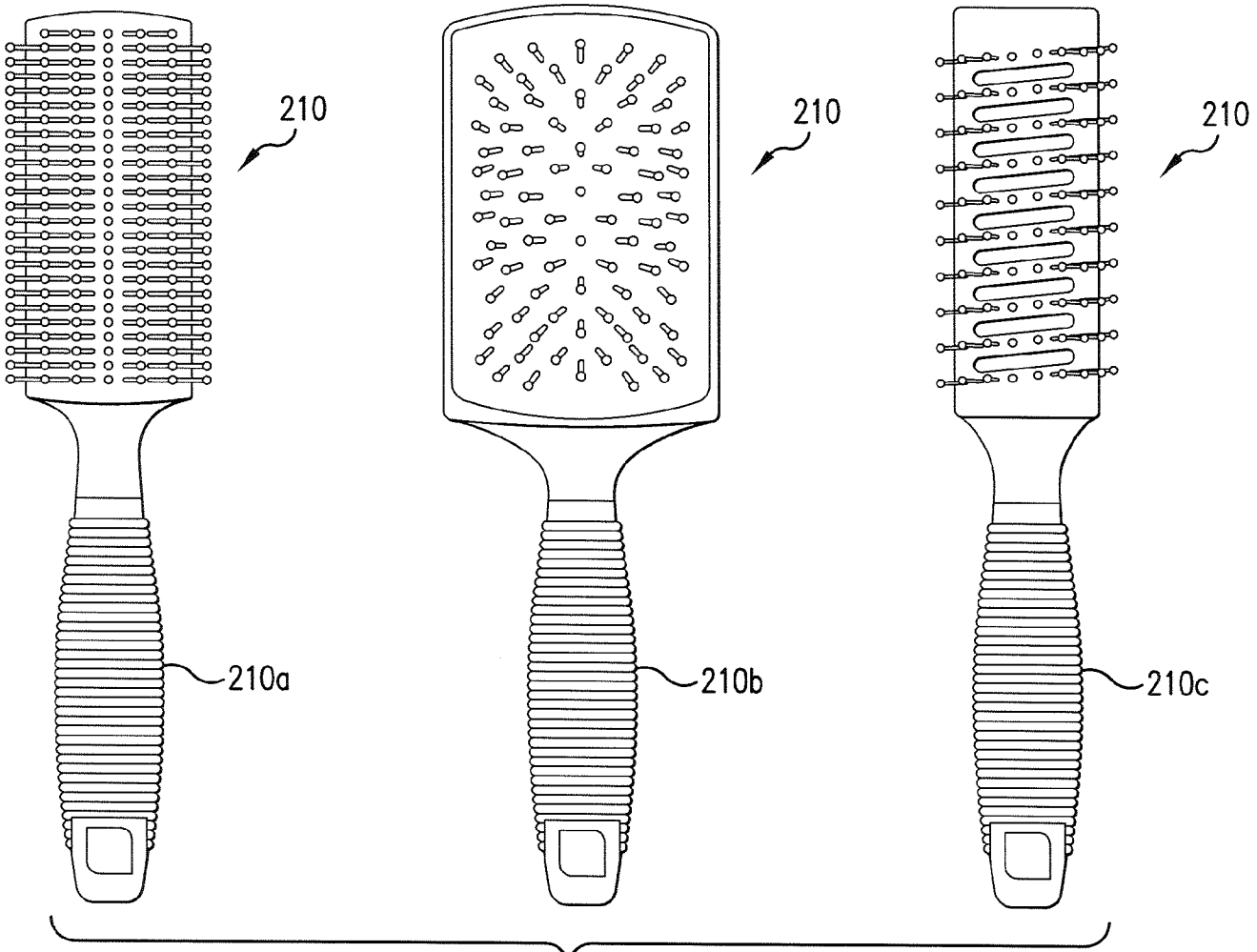
FIG. 2A is front view of example "start" brushes selected for a "start" step according to the method of FIG. 1.

FIG. 2A shows three brushes 210*a-c* (collectively, the "start brushes 210") that are well-suited for the detangling and drying step 110. The first brush 210*a* is a rubber base brush that is well-suited for all hair lengths and provides strength and control while styling. The second brush 210*b* is a ceramic paddle brush that is well-suited for medium-to-long hair of all textures and provides for styling while detangling. And the third brush 210*c* is a ceramic vent brush that is well-suited for all hair lengths and textures and is vented for fast drying. The depicted start brushes 210 are all frizz-free/antistatic and well-suited for adding volume while speeding the drying time.

Figure 2B:
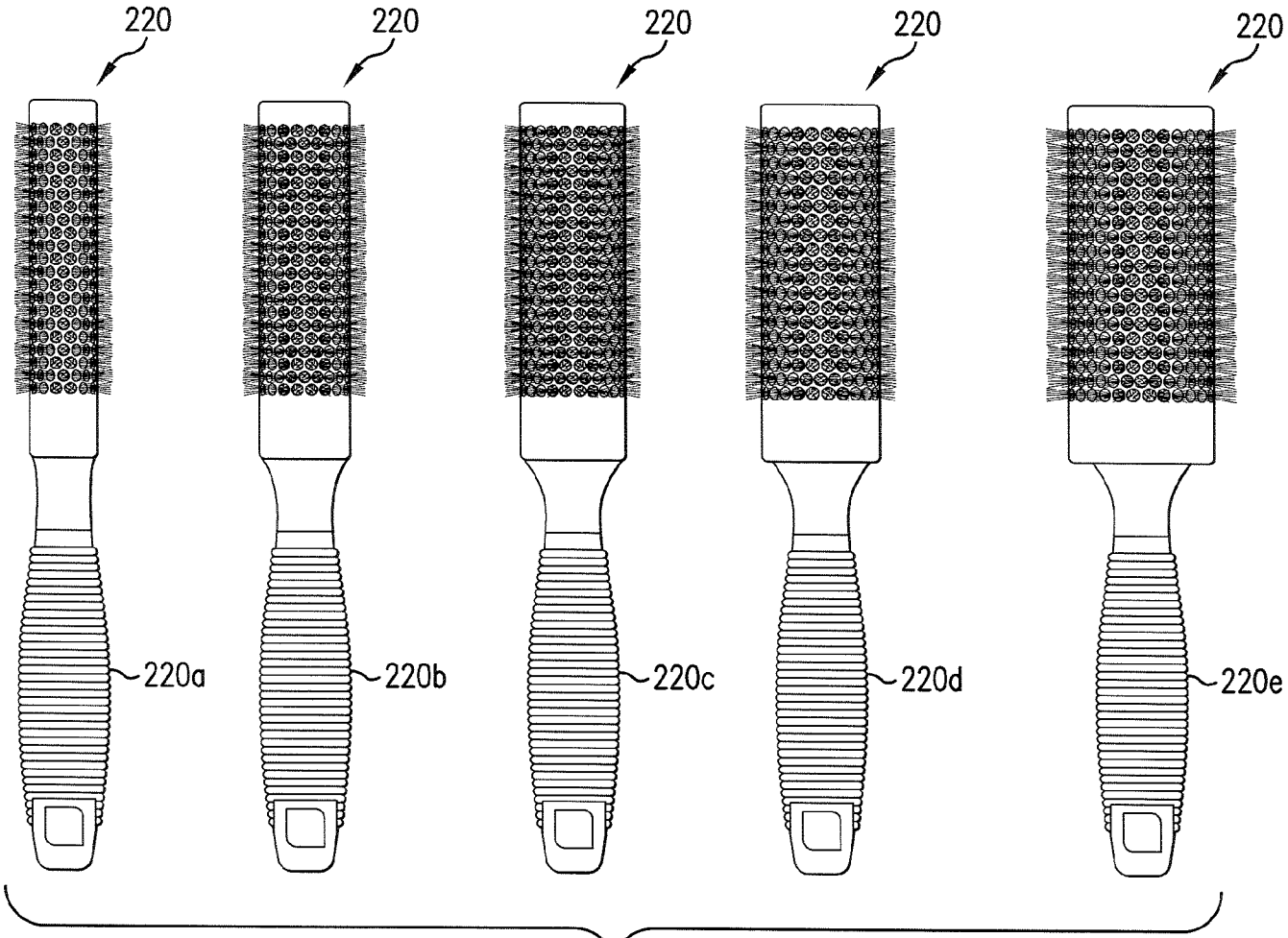
FIG. 2B is front view of example "style" brushes selected for a "style" step according to the method of FIG. 1.

FIG. 2B shows five brushes 220*a-e* (collectively, the "styling brushes 220") that are well-suited for the curling/straightening/adding volume/body step 120. Because this hairstyling step as defined includes disparate hairstyling options (e.g., curling versus straightening), a larger number of brushes may be selected than in the other hairstyling steps. The first brush 220*a* is a 25 mm (1") thermal round brush that is well-suited for adding volume and curl to short hair of any texture. The second brush 220*b* is a 33 mm (1.25") thermal round brush that is well-suited for adding volume/body and curl to short-to-medium hair of any texture. The third brush 220*c* is a 38 mm (1.5") thermal round brush that is well-suited for adding volume and curl to medium length hair of any texture. The fourth brush 220*d* is a 43 mm (1.75") thermal round brush that is well-suited for adding volume and straightening medium-to-long hair of any texture. And the fifth brush 220*e* is a 53 mm (2") thermal round brush that is well-suited for adding volume and straightening long hair of any texture. The depicted styling brushes 220 all preferably include color-protective bristles and frizz-free/antistatic features to provide a smooth look for even the most unruly hair types.

Figure 2C:
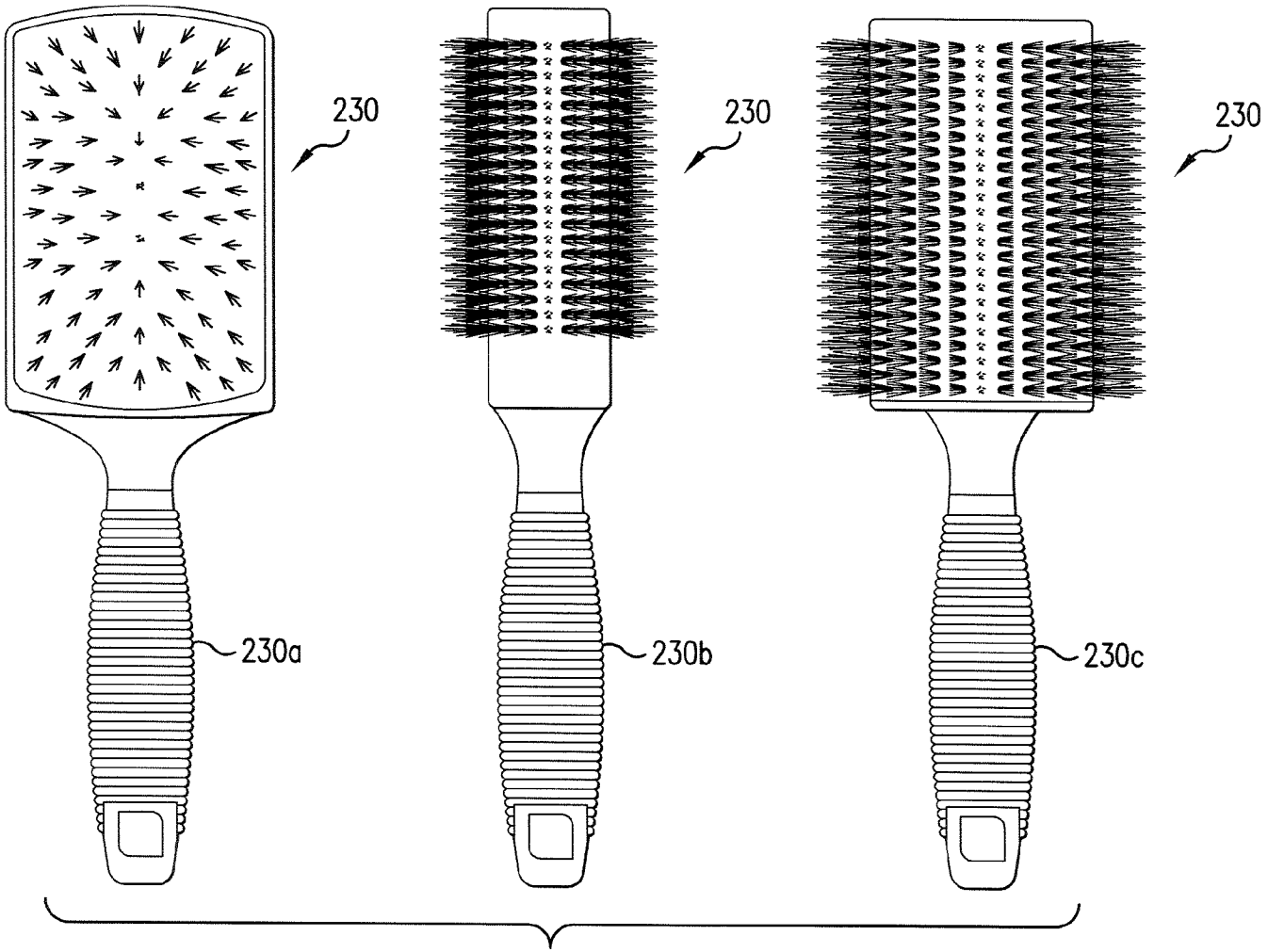
FIG. 2C is front view of example "finish" brushes selected for a "finish" step according to the method of FIG. 1.

FIG. 2C shows three brushes 230*a-c* (collectively, the "finish brushes 230") that are well-suited for the smoothening and shining step 130. The first brush 230*a* is a thermal boar paddle brush that is well-suited for smoothening and detangling all hair lengths and textures. The second brush 230*b* is a 38 mm (1.5") thermal boar round brush that is well-suited for smoothening hair of any texture and straightening medium-to-long hair or creating medium-sized curls. And the third brush 230*c* is a 70 mm (2.75") thermal boar round brush that is vented for fast drying and is well-suited for smoothening hair of any texture and straightening and adding body medium-to-long hair or creating larger curls.

The depicted styling brushes 230 all preferably include gentle-on-the-hair boar bristle brushes, are frizz-free/anti-static, and are infused with natural oils to speed drying time with less damage.

Figure 3:
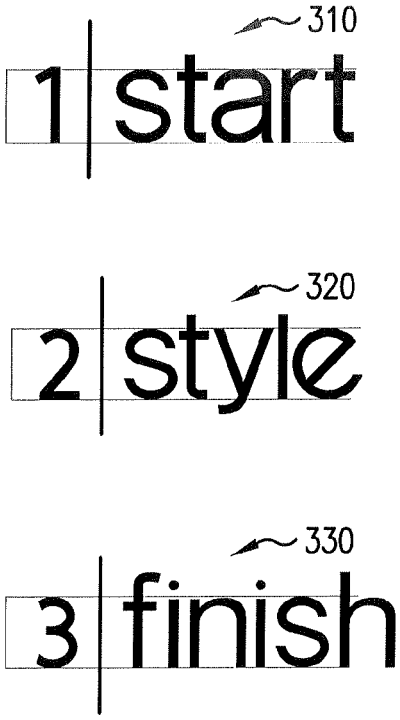
FIG. 3 shows example indicia for the start, style, and finish steps selected according to the method of FIG. 1.

Next, the method 10 of FIG. 1 includes at step 300 defining indicia relating to each of the hairstyling steps. Using the example hairstyling steps described above, FIG. 3 shows three example indicia 310, 320, 330 that may be selected for use with the hairstyling steps 110, 120, 130, respectively. The first indicium 310 includes the number "1" and the word "start" to denote that this is the first step. The second indicium 320 includes the number "2" and the word "style" to denote that this is the second step and the step in which the desired look is mostly created. And the third indicium 330 includes the number "3" and the word "finish" to denote that this is the final step when the "finishing" of the look is done. These example indicia 310, 320, 330 include numerically sequential indicia in combination with step-descriptive indicia. Alternatively, the indicia 310, 320, 330 may be numerically sequential only or step-descriptive only, and/or they may include alphabetic or alphanumeric elements, color-coded schemes, graphically or pictorially descriptive elements, or other elements to correlate to the hairstyling steps. Regardless of the format selected, the indicia correlate to the hairstyling steps so that users understand that a display of one of the indicia correlates to a corresponding one of the hairstyling steps.

Figure 4A:
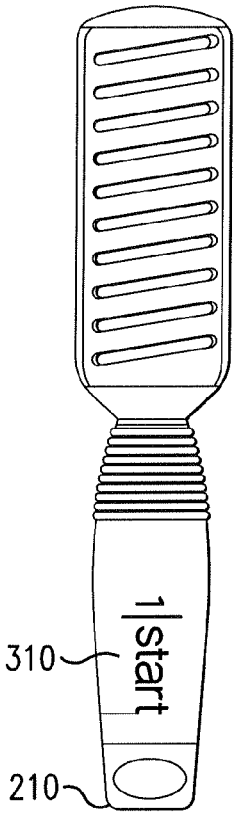
FIG. 4A is a front view of a start brush displaying the start indicia according to the method of FIG. 1.
Figure 4B:
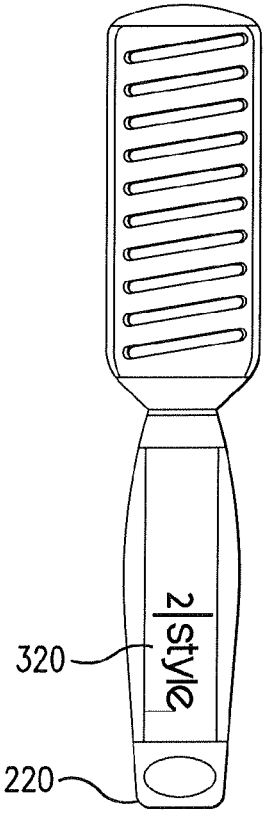
FIG. 4B is a front view of a style brush displaying the style indicia according to the method of FIG. 1.

Next, the method 10 includes at step 300 displaying the indicia for the hairstyling steps in connection with the advertising and sale of the corresponding hairstyling tools. Again using the example hairstyling steps described above, FIGS. 4A-B show start and style brushes 210, 220 that are suitable for use in the corresponding hairstyling steps 110, 120, respectively, and that are marked with the corresponding start and style indicia 310, 320, respectively. Similarly, finish brushes that are suitable for use in the corresponding smoothening and shining step 130 would display the corresponding finish indicium 330 (not shown). As depicted, the indicia 310, 320 are displayed on the hairstyling tools 210, 220, such as by marking the indicia on the hairstyling tools or on labels affixed to the tools.

Figure 5A:
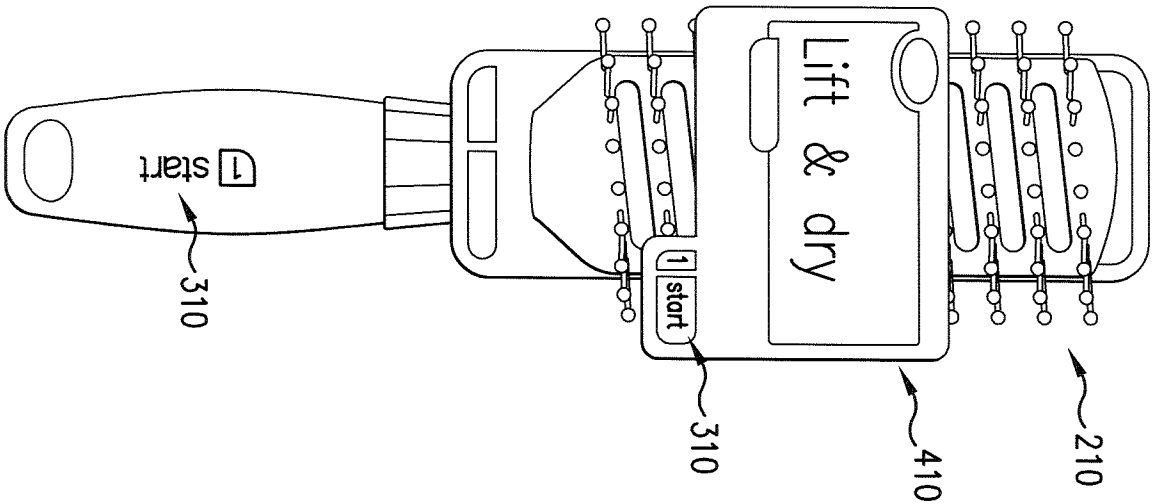
FIG. 5A is front view of an example start brush with packaging displaying the start indicia selected according to the method of FIG. 1.
Figure 5B:
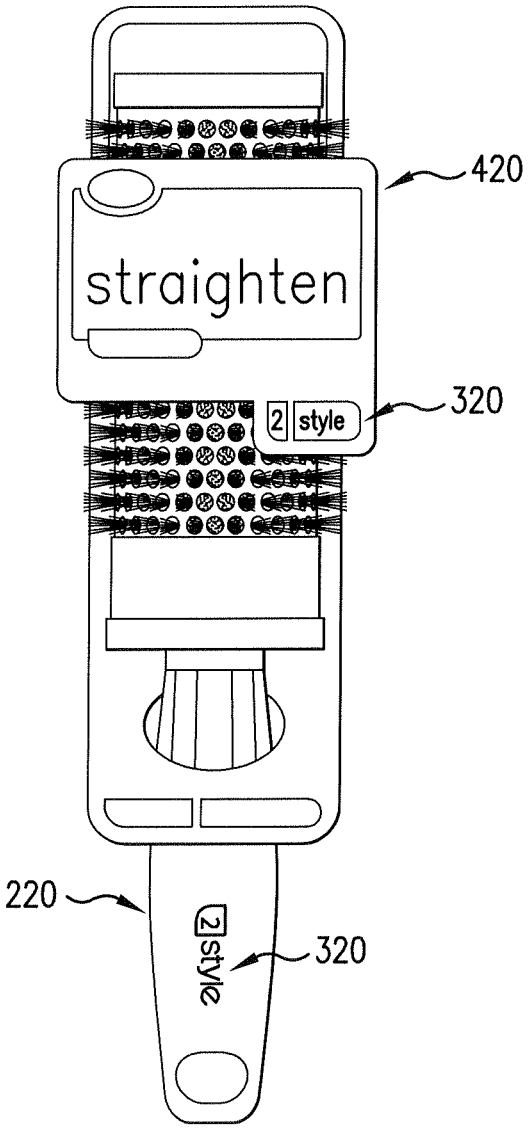
FIG. 5B is front view of an example style brush with packaging displaying the style indicia selected according to the method of FIG. 1.
Figure 5C:
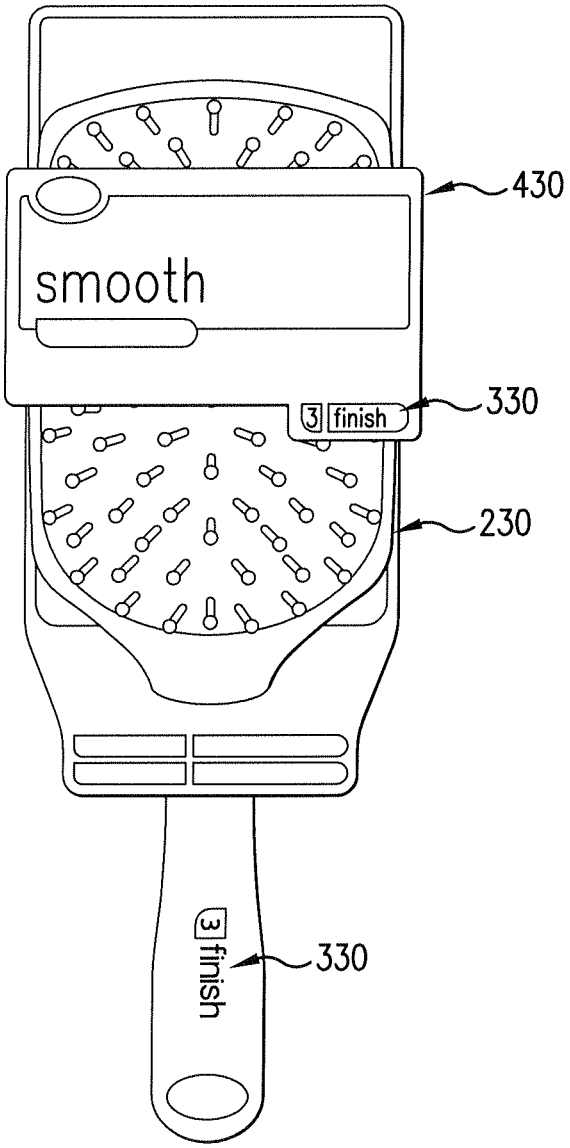
FIG. 5C is front view of an example finish brush with packaging displaying the finish indicia selected according to the method of FIG. 1.
Figure 6:
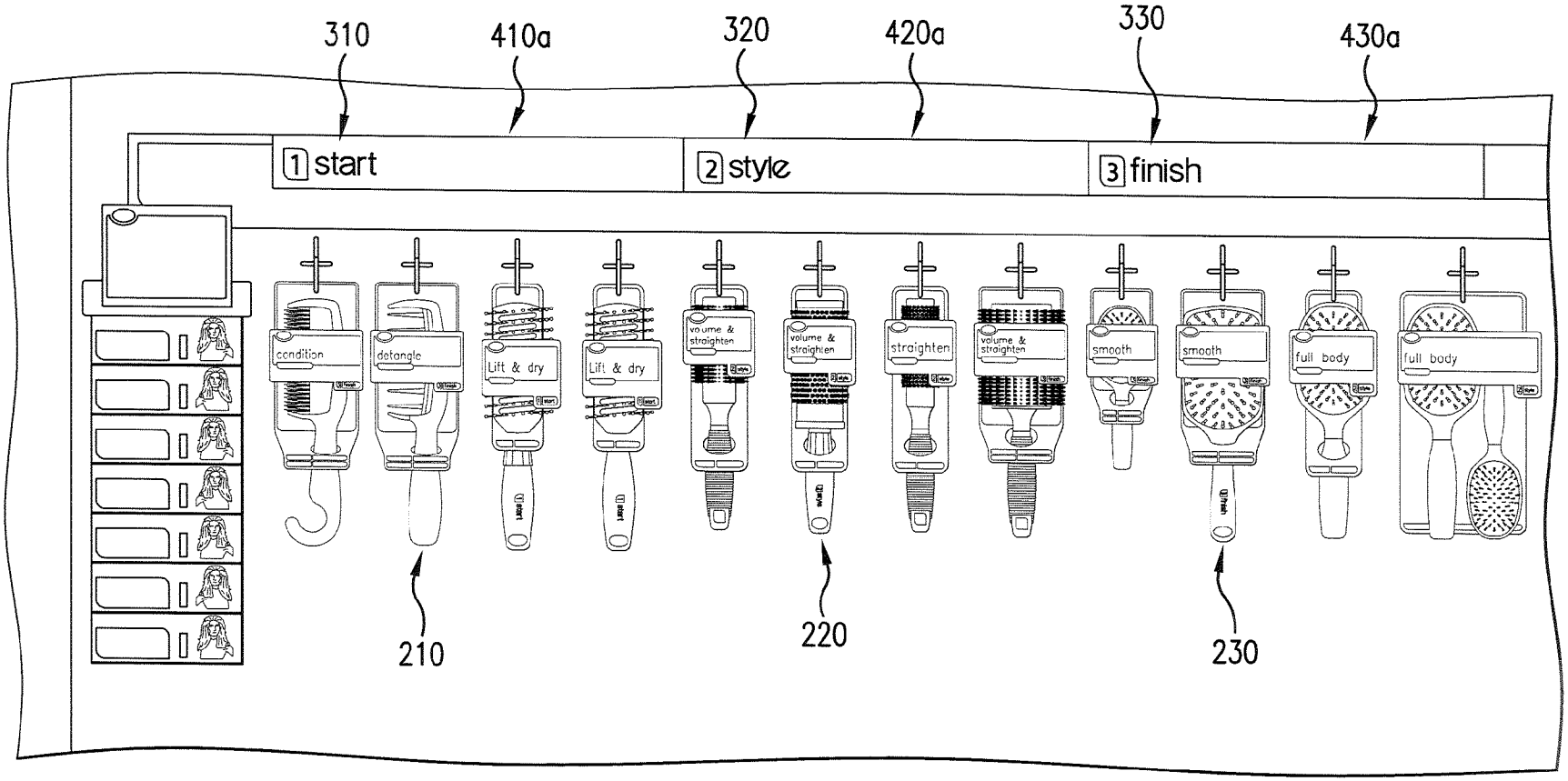
FIG. 6 is front view of a wall display of start, style, and finish brushes with signage segments displaying the start, style, and finish indicia selected according to the method of FIG. 1.
Figure 7A:
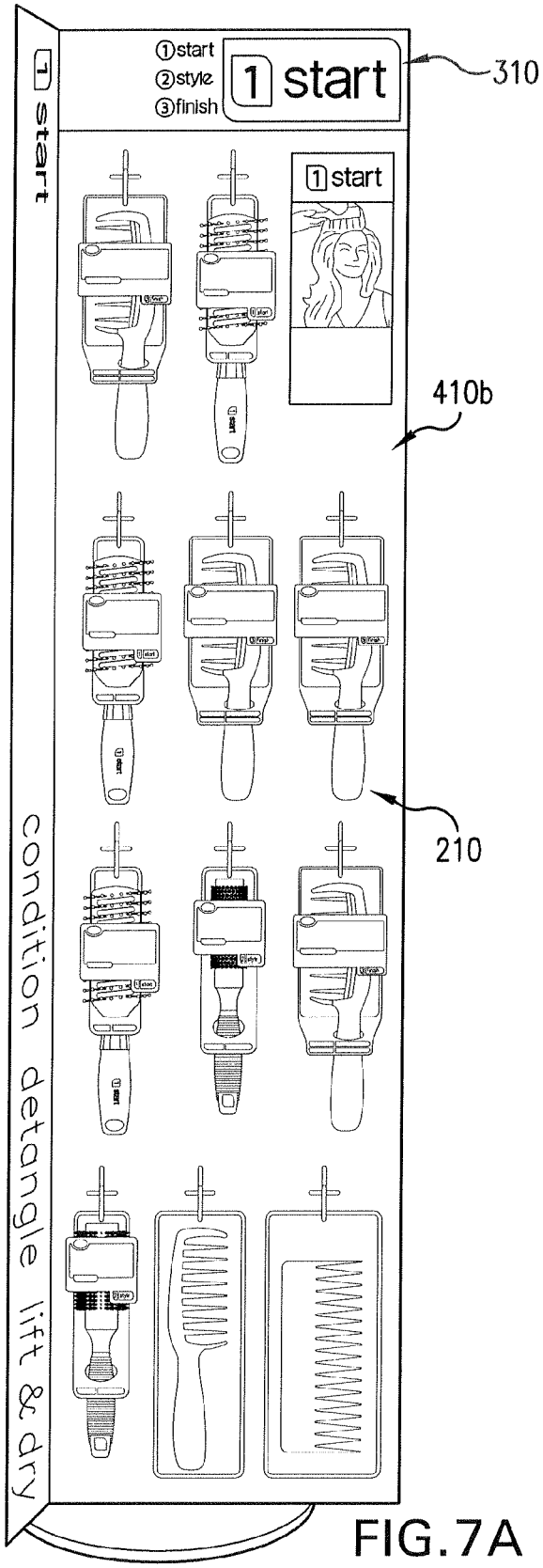
FIG. 7A is a perspective view of an example rotary display rack of hairstyling tools, showing a first side with start brushes and displaying the start indicia selected according to the method of FIG. 1.
Figure 7B:
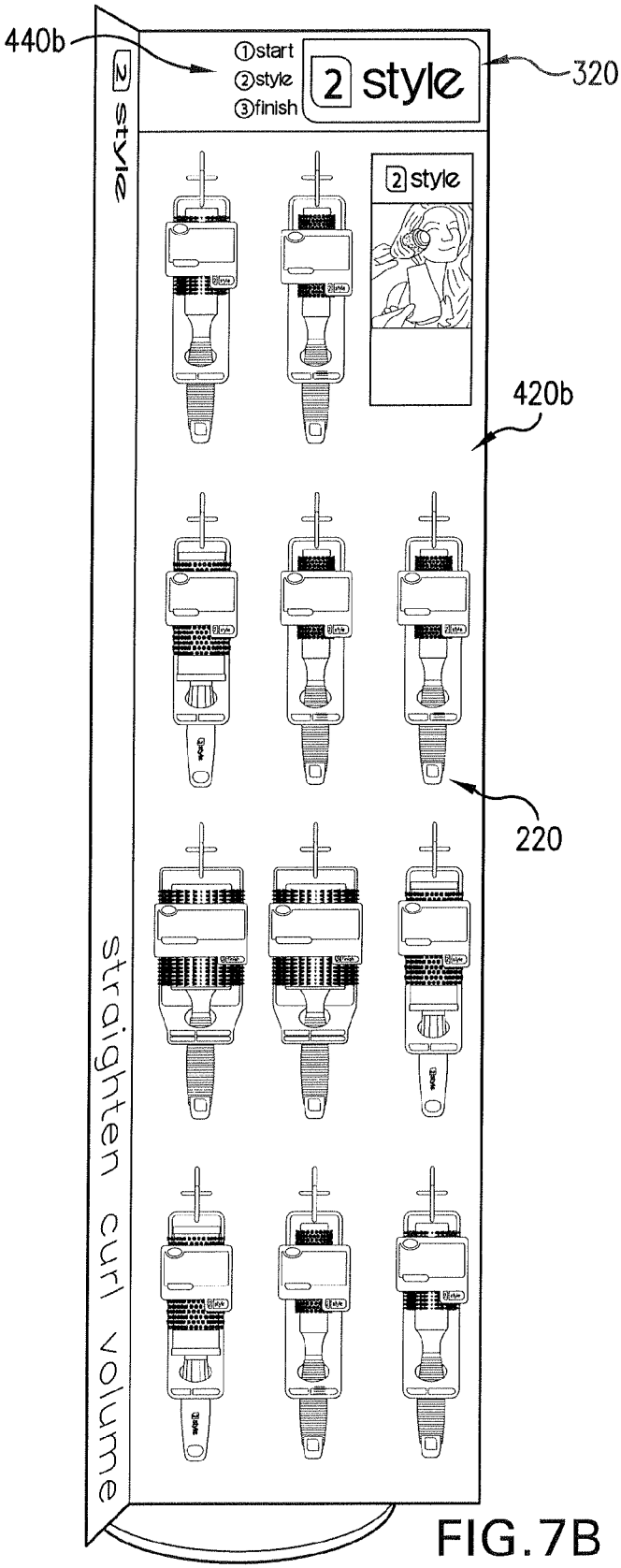
FIG. 7B is a perspective view of the display rack of FIG. 7A with the display rack rotated 120 degrees to show a second side with style brushes and displaying the style indicia selected according to the method of FIG. 1.
Figure 7C:
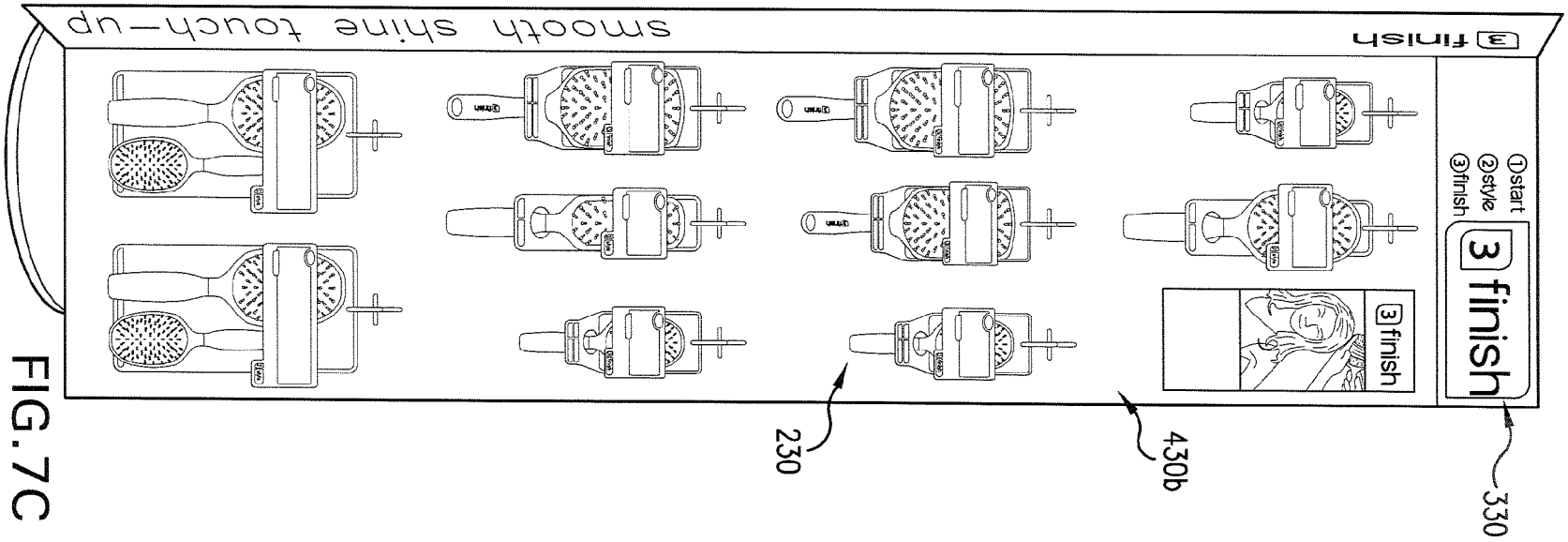
FIG. 7C is a perspective view of the display rack of FIG. 7A with the display rack rotated 240 degrees to show a third side with finish brushes and displaying the finish indicia selected according to the method of FIG. 1.
Figure 8A:
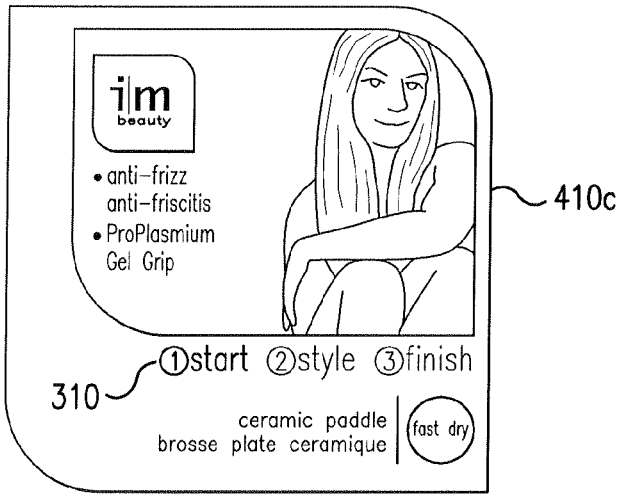
FIG. 8A is a plan view of a front cover of a tag displaying the start indicia for attaching to a start brush in accordance with the method of FIG. 1.
Figure 8B:
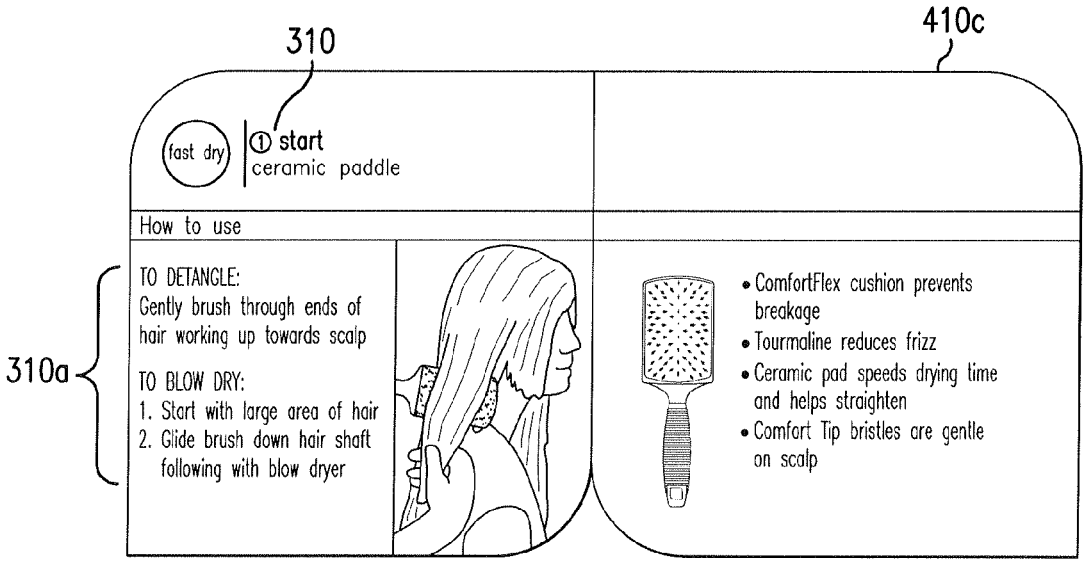
FIG. 8B is a plan view of inside sheets of the tag of FIG. 8A.
Figure 9A:
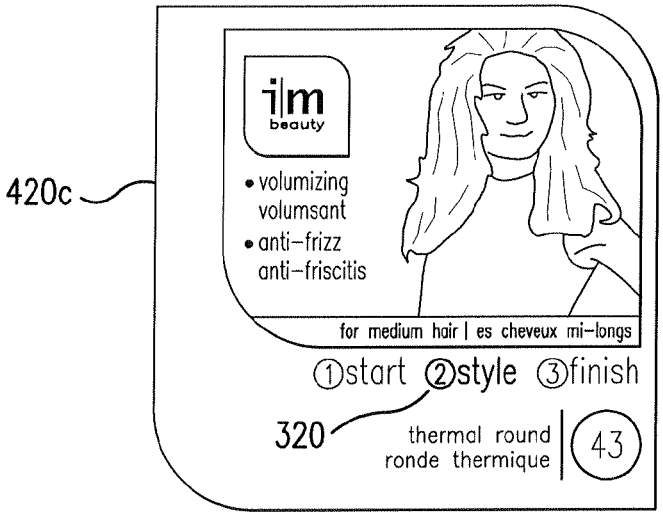
FIG. 9A is a plan view of a front cover of a tag displaying the style indicia for attaching to a style brush in accordance with the method of FIG. 1.
Figure 9B:
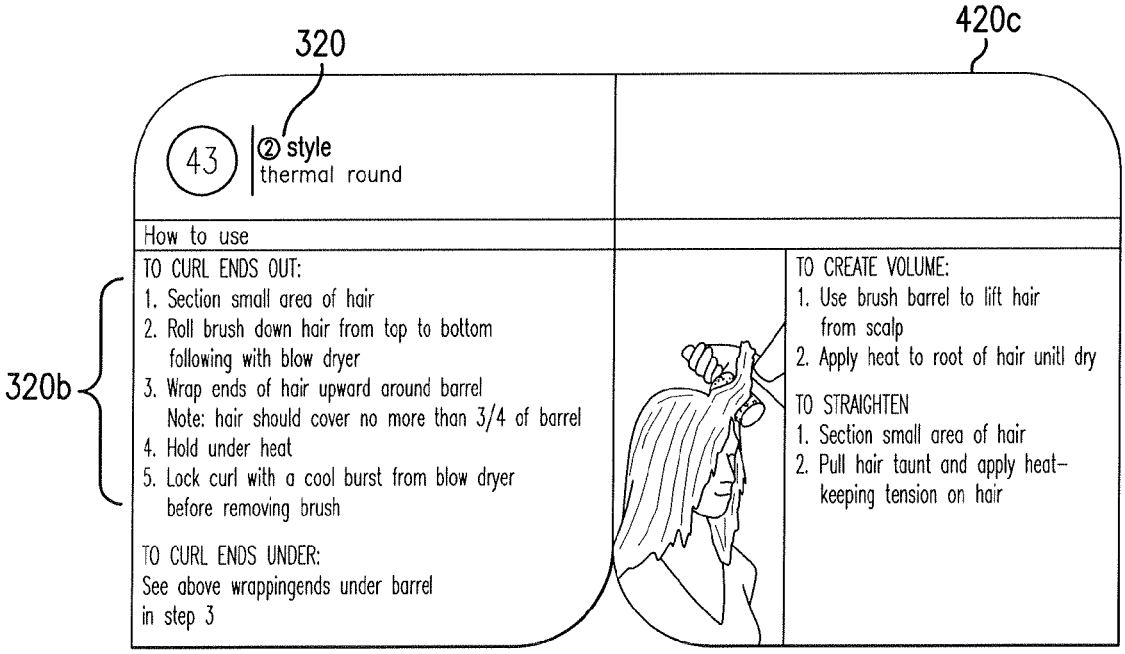
FIG. 9B is a plan view of inside sheets of the tag of FIG. 9A.
Figure 10A:
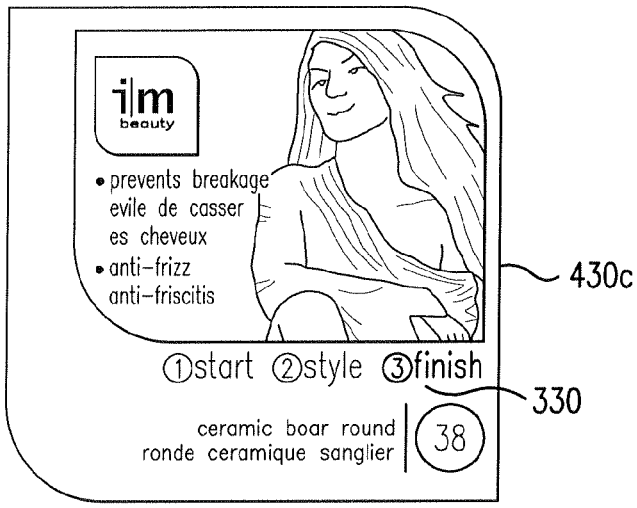
FIG. 10A is a plan view of a front cover of a tag displaying the finish indicia for attaching to a finish brush in accordance with the method of FIG. 1.
Figure 10B:
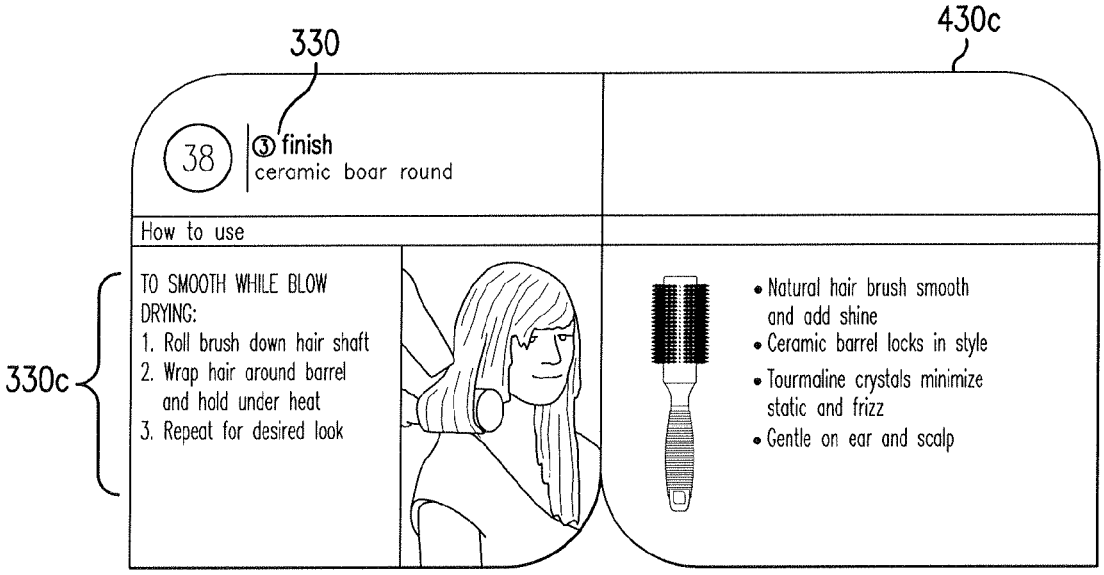
FIG. 10B is a plan view of inside sheets of the tag of FIG. 1A.
Figure 11:
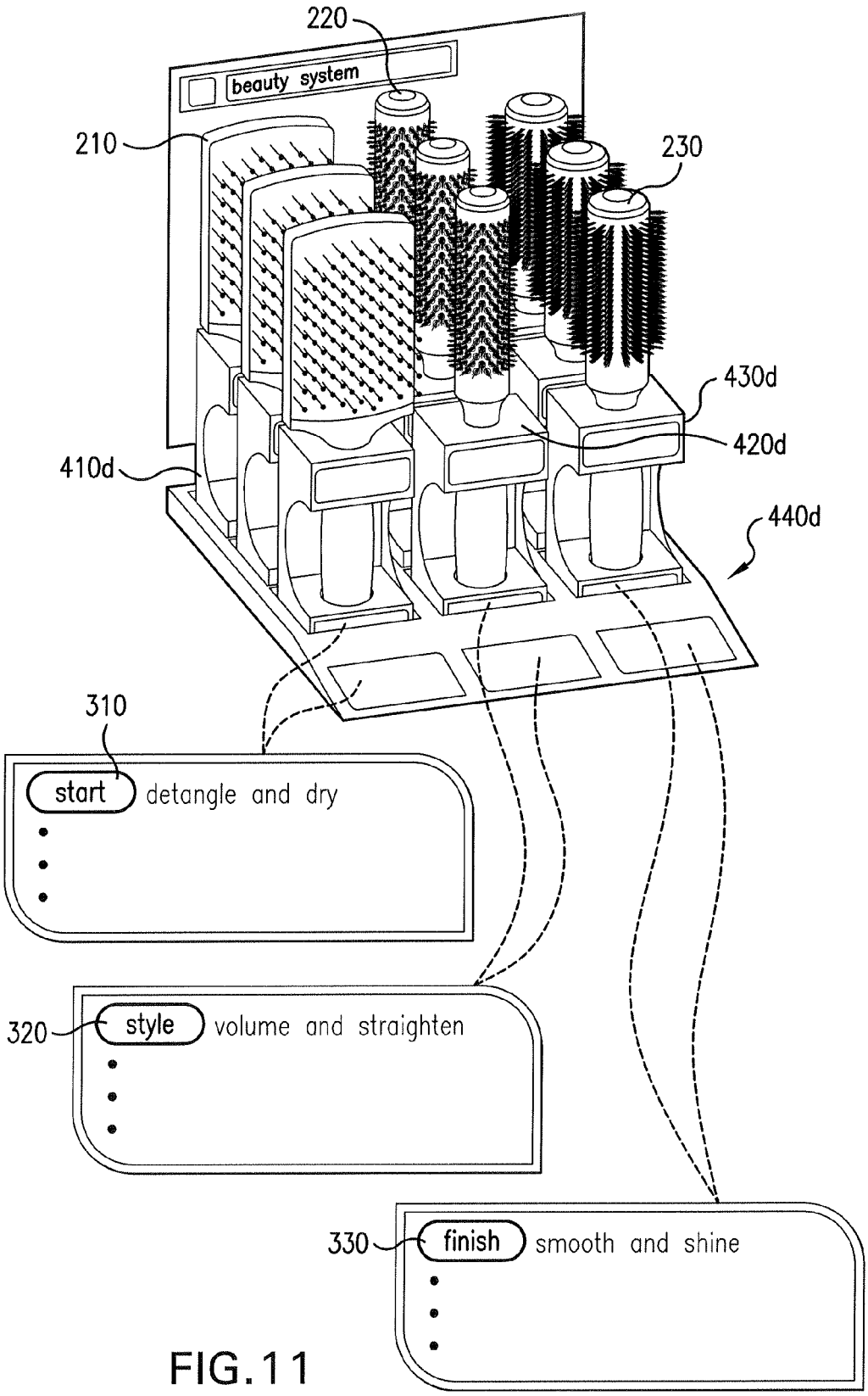
FIG. 11 is a perspective view of a display rack for start, style, and finish hairstyling tools in accordance with the method of FIG. 1.
Figure 12A:
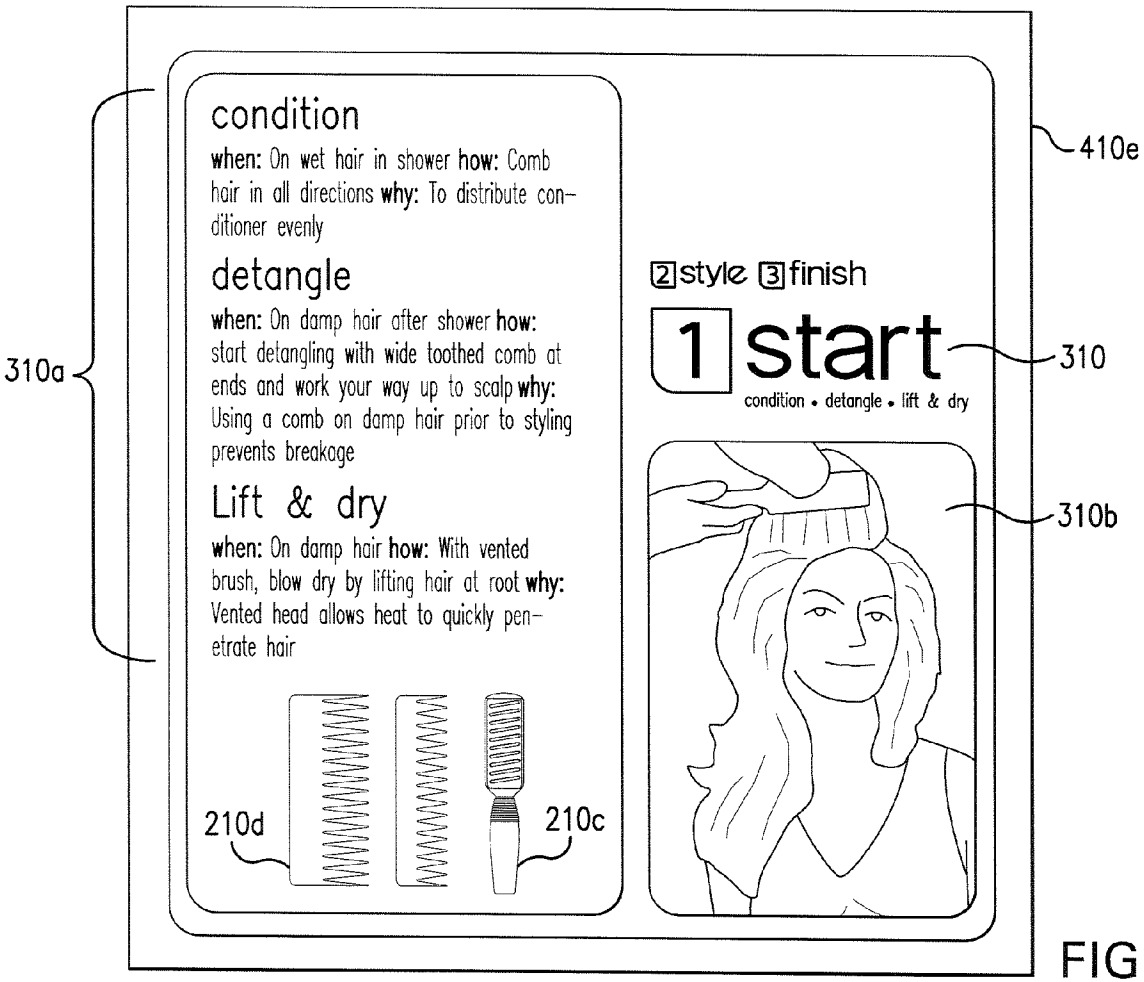
FIG. 12A is a plan view of a brochure sheet displaying the start indicia for distributing with a start brush in accordance with the method of FIG. 1.
Figure 12B:
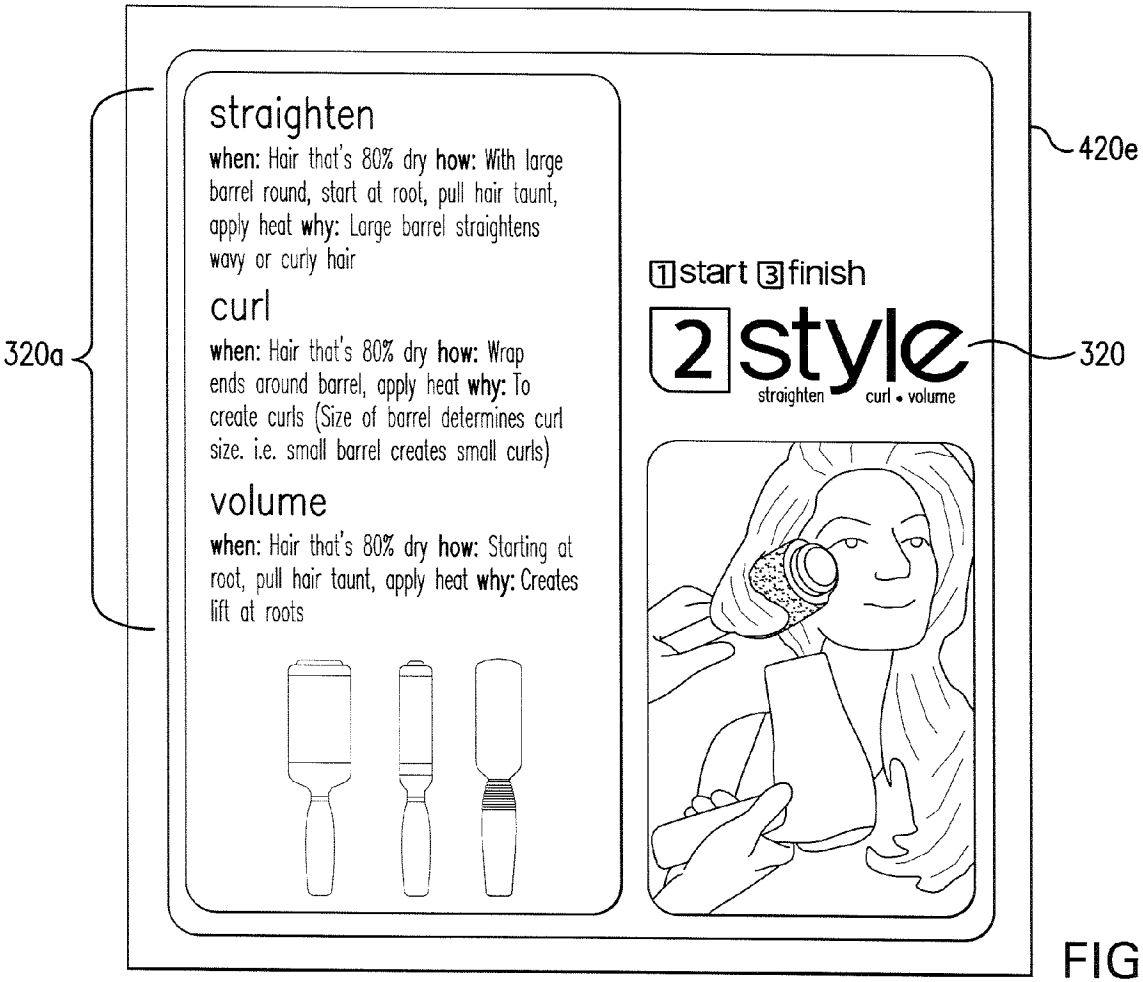
FIG. 12B is a plan view of a brochure sheet displaying the style indicia for distributing with a style brush in accordance with the method of FIG. 1.
Figure 12C:
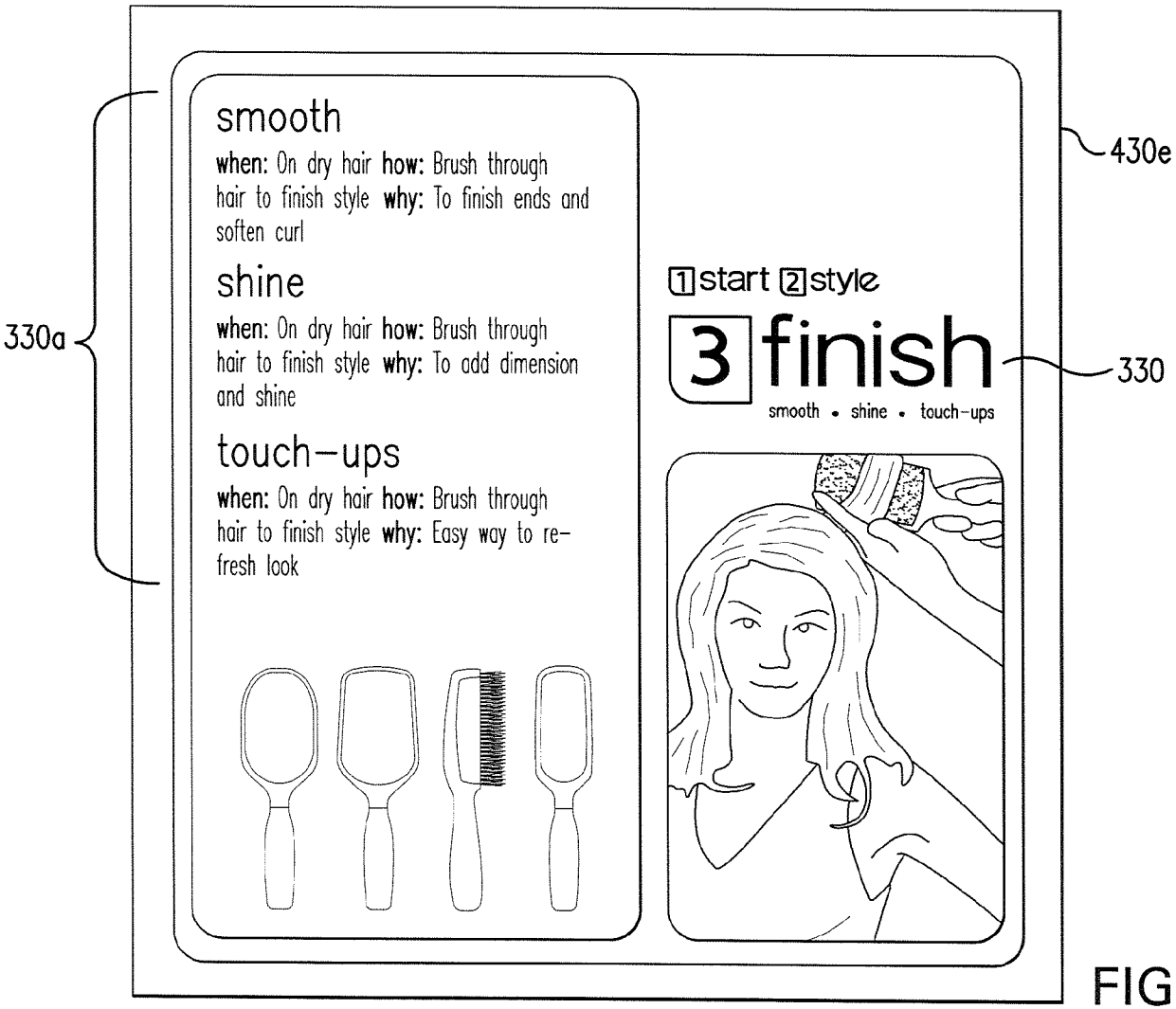
FIG. 12C is a plan view of a brochure sheet displaying the finish indicia for distributing with a finish brush in accordance with the method of FIG. 1.

In addition or alternatively, the indicia may be displayed on packaging for the hairstyling tools, on point-of-purchase displays for the hairstyling tools, on tags that are attached to the hairstyling tools, and/or on brochures or other advertising materials. For example, FIGS. 5A-C show the indicia 310, 320, 330 displayed on packaging 410, 420, 430, respectively, for the hairstyling tools 210, 220, 230, as well as on the tools themselves. FIG. 6 shows the indicia 310, 320, 330 on point-of-purchase signage segments 410*a*, 420*a*, 430*a* for the hairstyling tools 210, 220, 230. FIGS. 7A-C show the indicia 310, 320, 330 on a rotary point-of-purchase display rack 440*b* with three sides 410*b*, 420*b*, 430*b* for the hairstyling tools 210, 220, 230. FIGS. 8A-B, 9A-B, and 10A-B show the indicia 310, 320, 330 displayed on tags 410*c*, 420*c*, 430*c*, respectively, that may be attached to the hairstyling tools. FIG. 11 shows the indicia 310, 320, 330 marked on a display rack 440*d* for the hairstyling tools 210, 220, 230, respectively. The indicia 310, 320, 330 are preferably also included on the individual packaging 410*d*, 420*d*, 430*d* for each of the hairstyling tools 210, 220, 230. And FIGS. 12A-C show the indicia 310, 320, 330 displayed on brochures 410*e*, 420*e*, 430*e*, respectively, for the hairstyling tools. In all of these displays, the indicia 310, 320, 330, or the background surrounding the indicia, are preferably color-coded using three distinct colors, for example, blue for the start step 110, red for the style step 120, and green for the finish step 130.

The method 10 of FIG. 1 may optionally include the step of defining written instructions for implementing each of the hairstyling steps, and displaying the written instructions in connection with the advertising and sale of the corresponding hairstyling tools. For example, the hangtags 410, 420, 430 of FIGS. 8A-B, 9A-B, and 10A-B, and the brochures 410*b*, 420*b*, 430*b* of FIGS. 12A-C, each display specialized written instructions 310*a*, 320*a*, 330*a* for how and when to use each of the hairstyling tools 210, 220, 230 to perform the hairstyling steps 110, 120, 130, respectively. As can be seen in 12A, the advertising materials 410*b* may also include a graphic or pictorial representation 310*b* depicting the hairstyling step 110, and graphic or pictorial representations of the hairstyling tools 210*c* and 210*d* that are used in that step. The depicted tags and brochures may be provided separately with their corresponding hairstyling tools, or they may be combined into single tags and brochures for use with any of the hairstyling tools.

The written instructions shown in the figures are for illustrative purposes only. By way of example, alternative written instructions may include the following to help the consumer choose which brush is right for her by guiding her through her hair type, when she would use that particular brush, and how to properly use that brush.

For the rubber base start brush 210*a*, the instructions may be:

To detangle: Gently detangle hair from ends and work up to scalp.

To blow dry: Start with a small section of hair for maximum control. Lift hair up and out with heat from a blow dryer. Pull hair especially tight for overly curly hair types.

For the ceramic paddle start brush 210*b*, the instructions may be:

To detangle: Start from ends and work up to scalp. Comfort Flex pad prevents breakage.

To blow dry: Start with large section of hair. Glide brush down hair shaft (top to bottom) following with blow dryer to tame unwanted frizz.

For the ceramic vent start brush 210*c*, the instructions may be:

To detangle: Start from ends and work up to scalp. Comfort Flex pad prevents breakage.

To blow dry: Start with small section of hair for maximum control. Glide brush down hair shaft following with blow dryer. For faster drying time, use brush to pull hair away from scalp and allow heat to flow through vented design.

For the five different-sized thermal round style brushes 220, the instructions may be:

To curl ends out: Start with a small section of hair, roll brush down hair shaft (top to bottom) following with a blow dryer. Wrap hair around barrel upwards starting at ends so brush barrel is approx ¾ covered with hair; hold under heat for a few seconds. Repeat several times and finish by locking in curl with a cool blast from blow dryer before removing brush barrel from hair. Move to next section.

To curl ends under: Use steps above but curl under to frame face.

To create volume: Pull hair tight from scalp with brush barrel and blow dry upward and outward from every angle. Be sure both hair and scalp are thoroughly dry for maximum hold.

To straighten: Start with small section of hair, roll brush down hair shaft (top to bottom) following with blow dryer. Wrap brush barrel around underside of hair and pull tightly keeping tension while drying. Repeat several times until straight.

For the ceramic boar paddle finish brush 230*a*, the instructions may be:

To finish and maintain style: Start from ends and work up to scalp. Nylon bristles help give direction to your style by penetrating hair while Natural Boar Bristles smooth frizz and fly-aways.

For the 1.5" ceramic boar round finish brush 230*b*, the instructions may be:

To smooth while blow drying: Roll brush down hair shaft. Wrap hair around barrel; hold under heat for several seconds. The Natural boar bristles create shine by distributing hair's natural oils while smoothing cuticle.

And for the 2.75" ceramic boar round finish brush 230*c*, the instructions may be:

To smooth while blow drying: Roll brush down hair shaft. Wrap hair around barrel; hold under heat for several seconds. The natural boar bristles create shine by distributing hair's natural oils while smoothing the cuticle.

In another aspect, the invention includes a system of hairstyling tools according to the systematizing method 10. In an example embodiment, the system includes all of the hairstyling tools 110, 120, 130 described herein. In another aspect, the invention includes one or more individual hairstyling tools of a system of hairstyling tools according to the systematizing method 10. Example embodiments of this aspect of the invention include the individual hairstyling tools 110, 120, 130 described herein. Those skilled in the art will understand that the scope of the present invention includes these and other individual hairstyling tools and other systems of hairstyling tools according to the disclosure and teachings of the present application and drawings.

Figure 13:
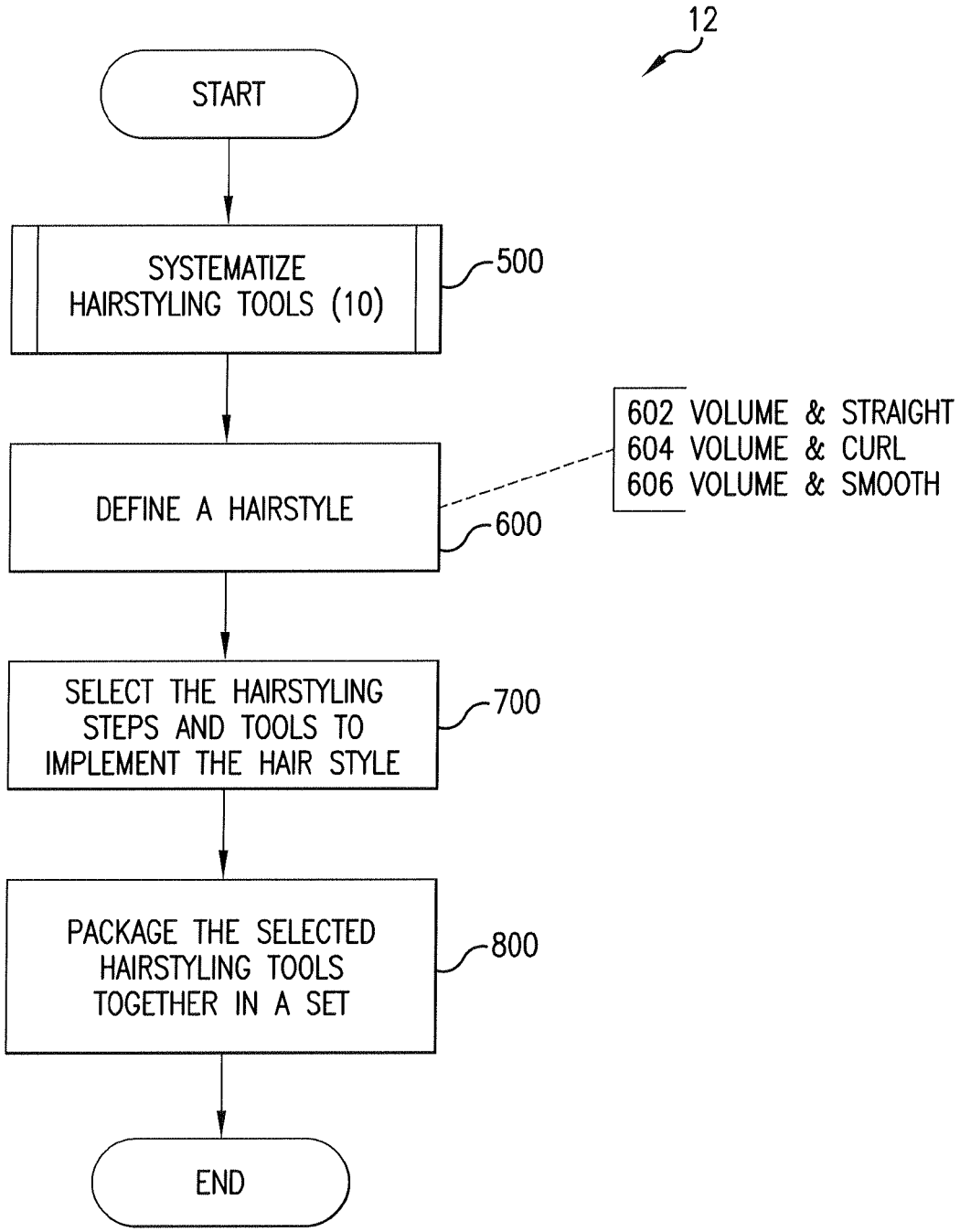
FIG. 13 is a flow diagram of a second example method of systematizing hairstyling tools according to the present invention.

In yet another aspect of the invention, there is provided a second method 12 of systematizing hairstyling tools. Referring to FIG. 13, there is shown one such example method 12 according to the present invention. The method 12 at step 500 includes systematizing hairstyling tools according to the method 10 described above. In addition, the method 12 includes at step 600 defining a hairstyle for a hair type. For example, step 600 may include defining first, second, and third hairstyles 602, 604, 606. The first hairstyle 602 can be "volume and straight" for a sleek, straight styles for medium to long length hair or layered bobs. The second hairstyle 604 can be "volume and curl" for a silky, sophisticated look for all hair lengths. And the third hairstyle 606 can be "volume and smooth" for creating volume while still smoothening and straightening, for medium to long length hair, brittle hair, and/or dry hair. Alternatively, step 600 may include defining more or fewer than three hairstyles and/or may include other hairstyles than the three hairstyles 602, 604, 606 described herein (and/or other names for the same hairstyles). For example, step 600 may included defining new or back-in hairstyles such as "volume and tease," big and natural," wave and curl," sleek and smooth," "straight and flip," etc.

Figure 14A:
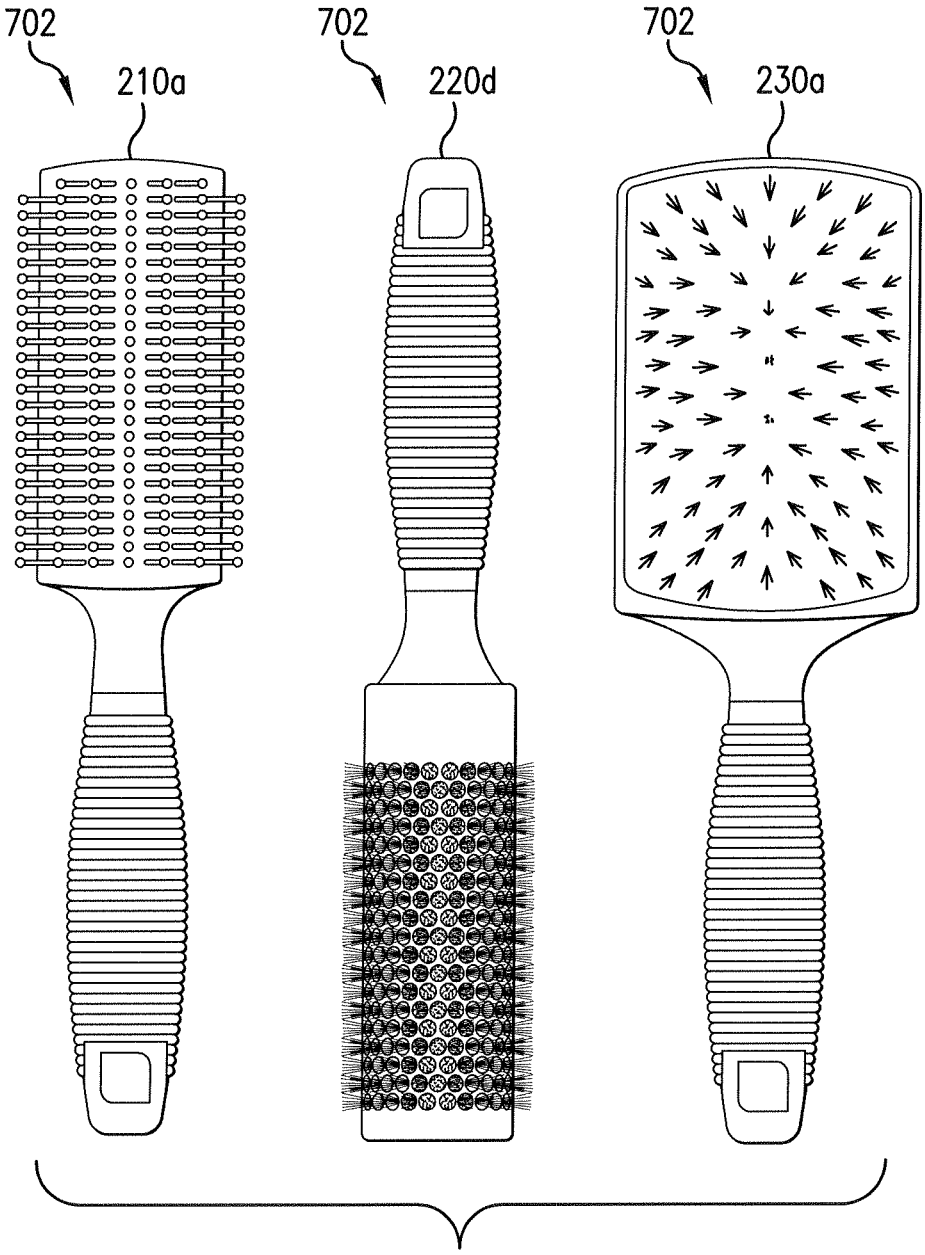
FIG. 14A is front view of example start, style, and finish hairstyling tools selected for creating a "volume and straight" hairstyle according to the method of FIG. 13.
Figure 14B:
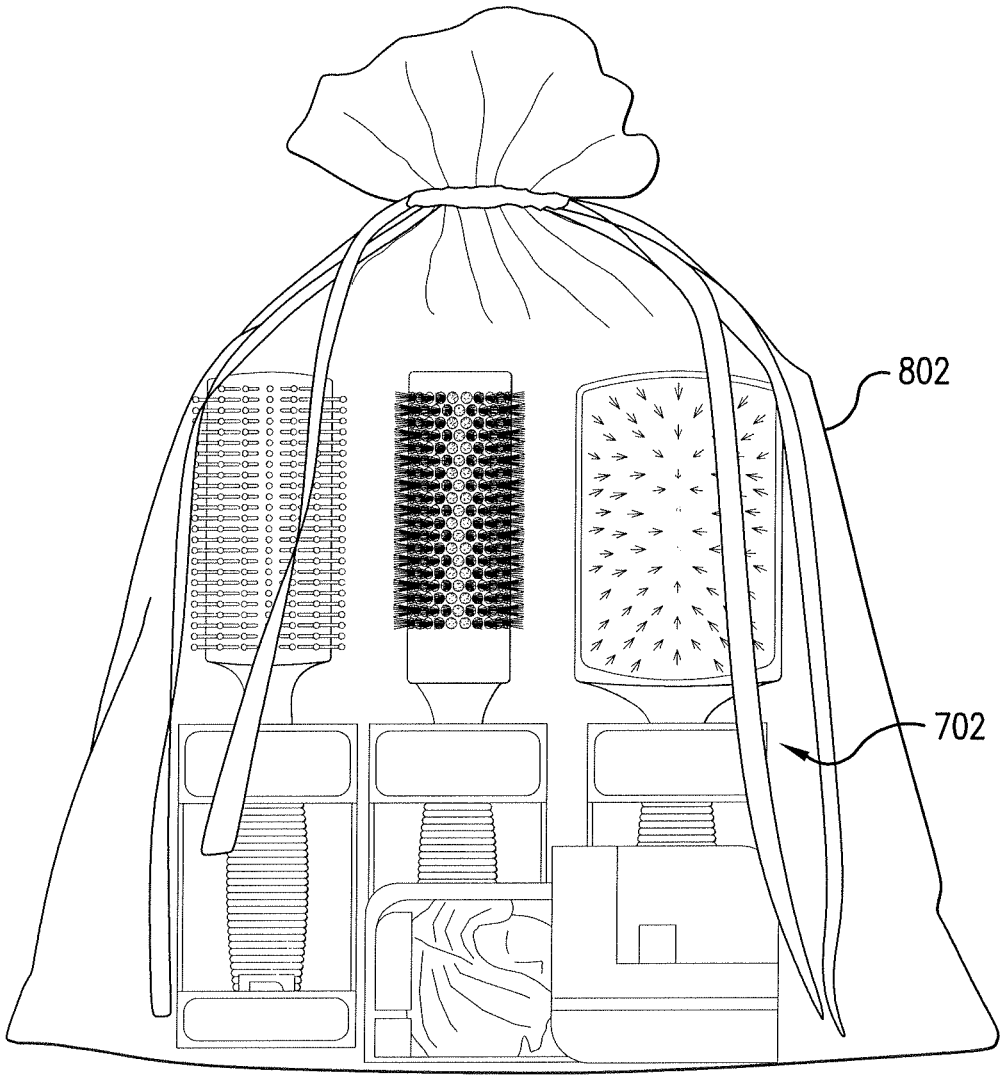
FIG. 14B is front view of the hairstyling tools of FIG. 14A packaged together as a set.
Figure 15A:
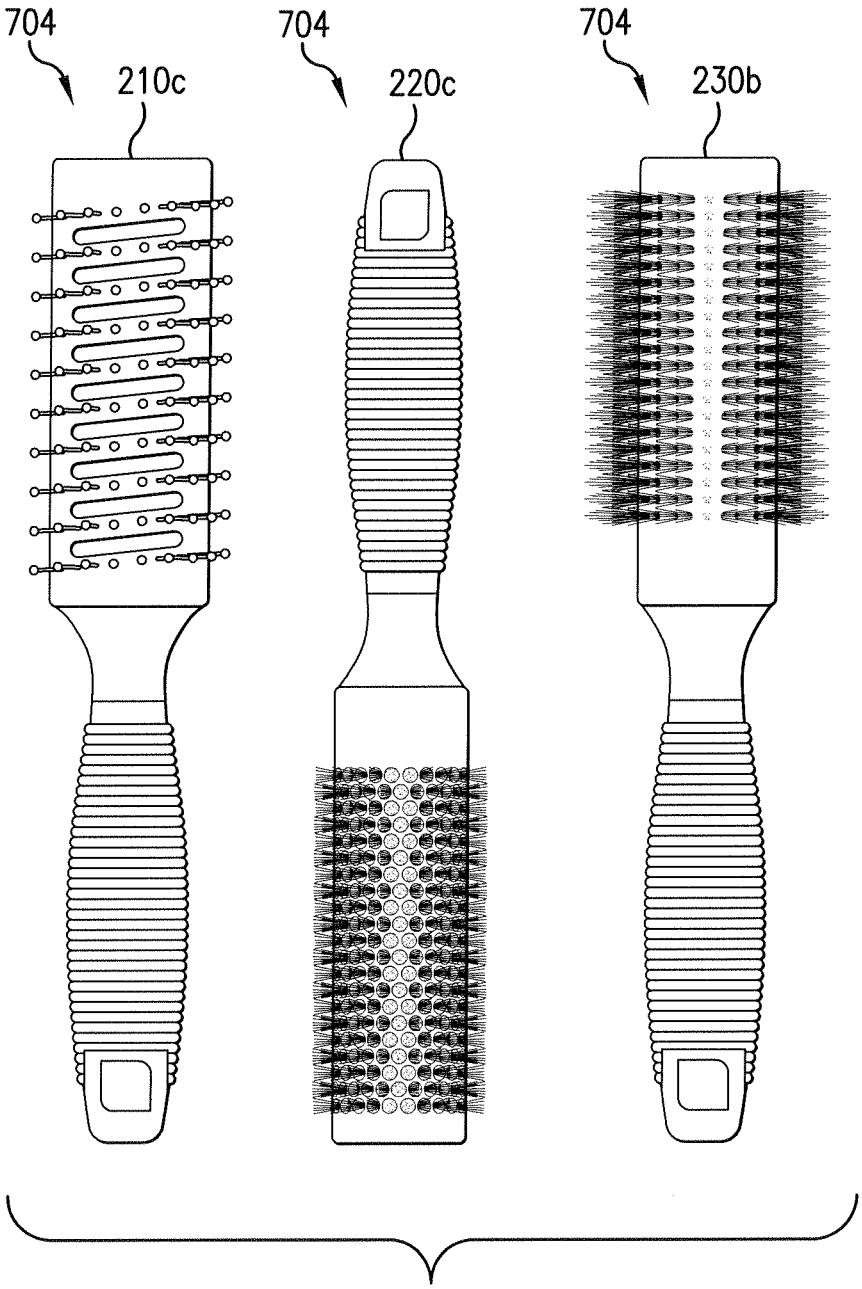
FIG. 15A is front view of example start, style, and finish hairstyling tools selected for creating a "volume and curl" hairstyle according to the method of FIG. 13.
Figure 15B:
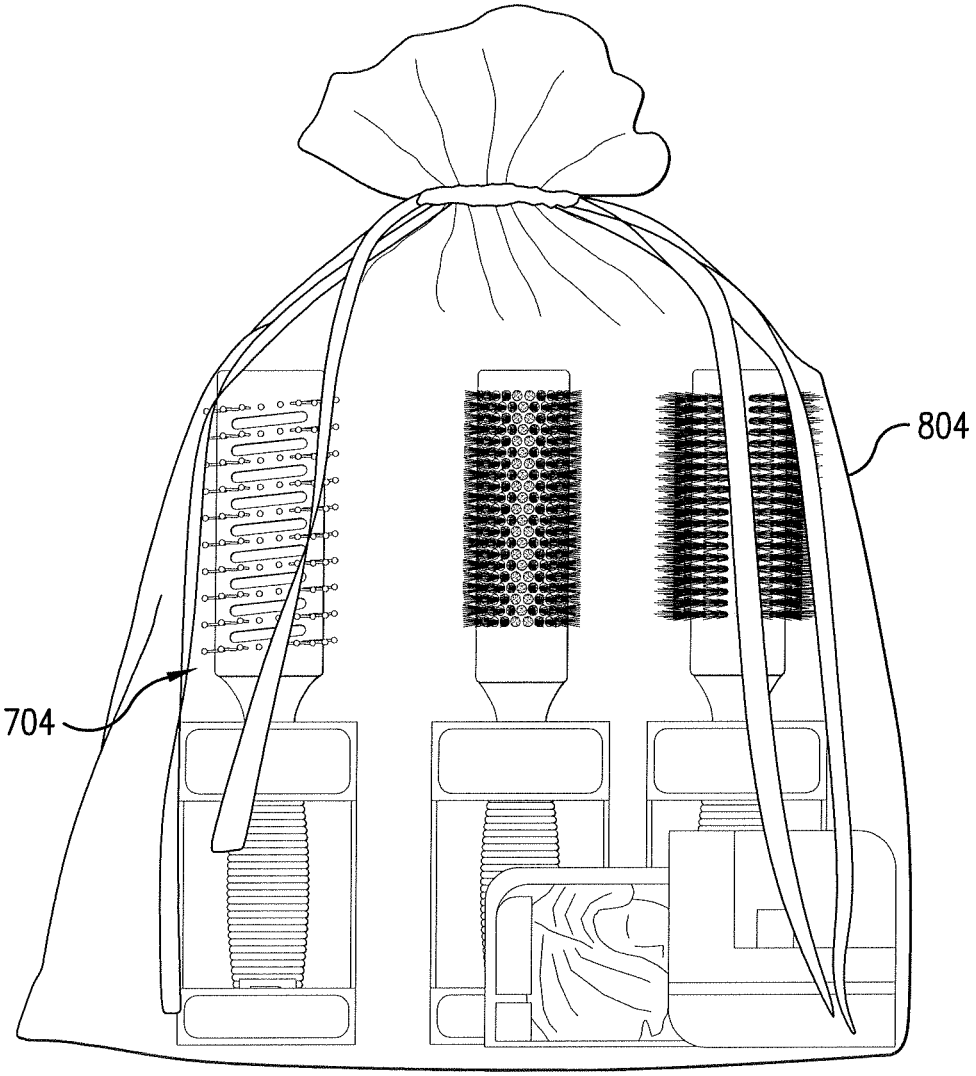
FIG. 15B is front view of the hairstyling tools of FIG. 15A packaged together as a set.
Figure 16A:
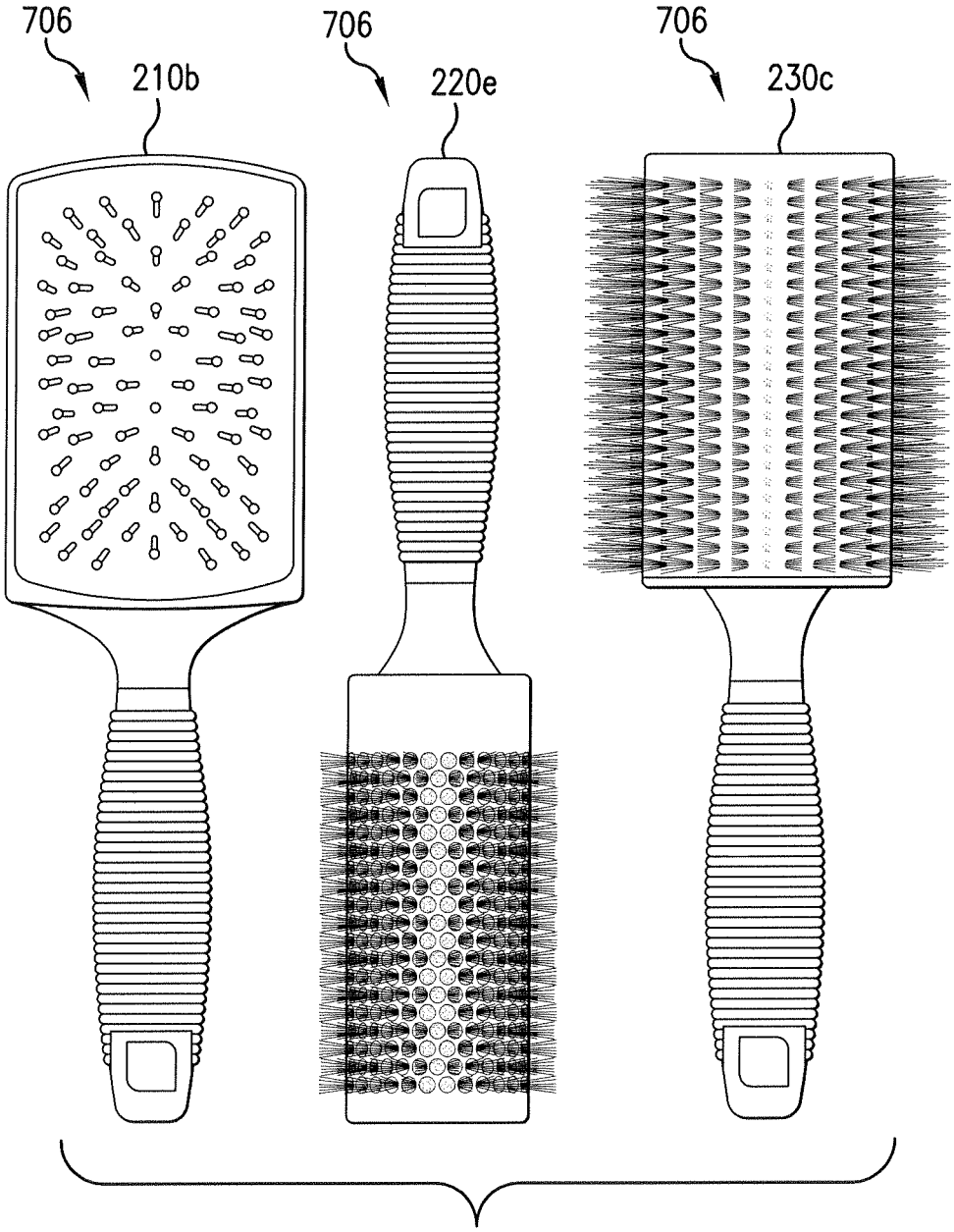
FIG. 16A is front view of example start, style, and finish hairstyling tools selected for creating a "volume and smooth" hairstyle according to the method of FIG. 13.
Figure 16B:
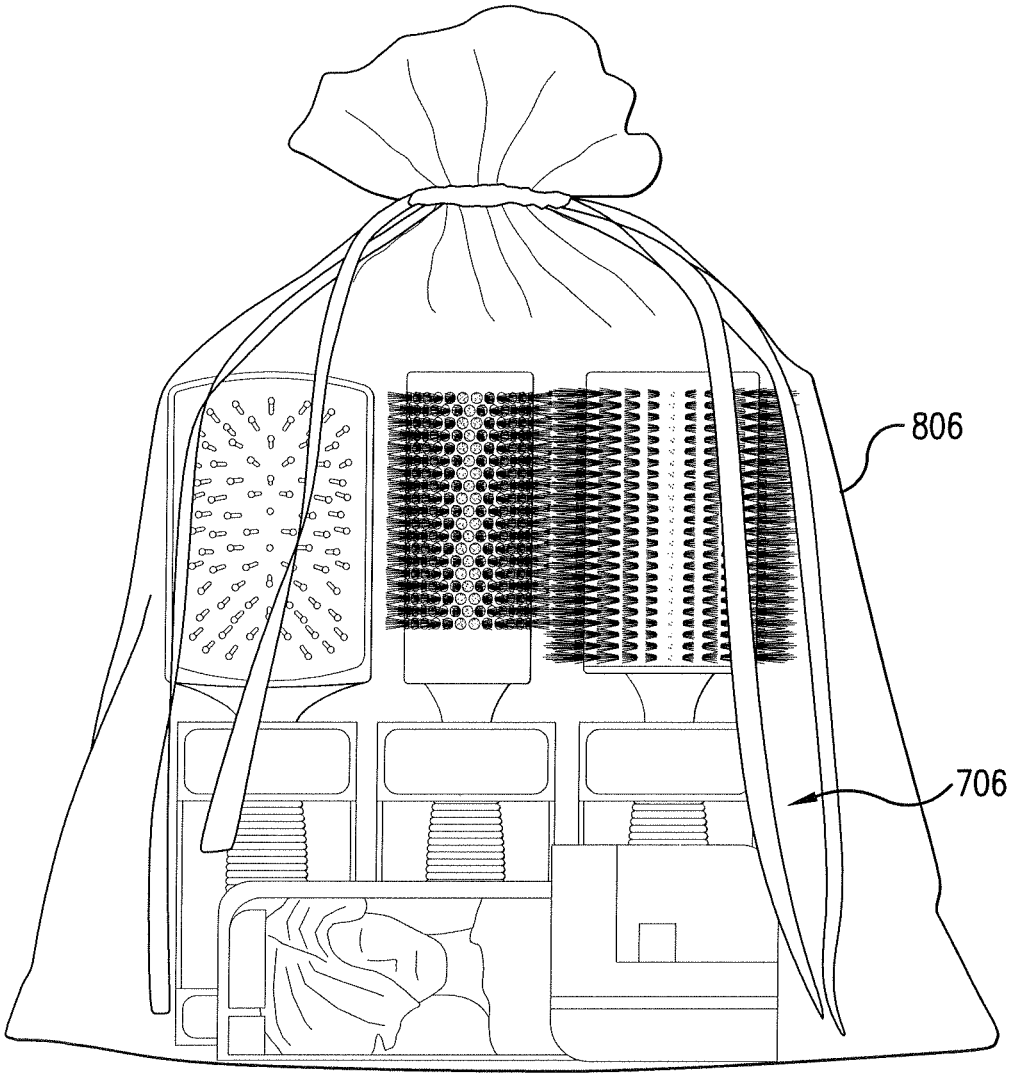
FIG. 16B is front view of the hairstyling tools of FIG. 16A packaged together as a set.

Next, at step 700 the method 12 includes, for each hairstyle 602, 604, 606, selecting the hairstyling steps and tools to implement that particular hairstyle. And then step 800 is to package the selected hairstyling tools together as a set. Using the example from above, FIGS. 14A-B show a set 702 of the hairstyling tools for the "volume and straight" hairstyle 602, namely a start tool 210*a*, a style tool 220*d*, and a finish tool 230*a*, with the hairstyling tools selected for the particular hairstyling steps needed to create the style and with the set combined together in a package 802. FIGS. 15A-B show a set 704 of the hairstyling tools for the "volume and curl" hairstyle 604, namely a start tool 210*c*, a style tool 220*c*, and a finish tool 230*b*, with the set combined together in a package 804. And FIGS. 16A-B show a set 706 of the hairstyling tools for the "volume and smooth" hairstyle 606, namely a start tool 210*b*, a style tool 220*e*, and a finish tool 230*c*, with the set combined together in a package 802. In the depicted embodiments, the package 802, 804, 806 is a brown organza bag that also includes the brochures 430*a*, 430*b*, 430*c* of FIGS. 12A-C. It will be understood that the sets 702, 704, 706 of hairstyling tools can be displayed together for individual sale or packaged together for sale together as a set, as may be desired.

Those of ordinary skill in the art will understand that step 600 can be performed before or after performing steps 100 and 200 of the first method 10. If step 600 is performed beforehand, then steps 100 and 200 of the first method 10 would include the hairstyling step and tool selection of step 700, so this step 700 would not need to be repeated in the second method 12. In any event, the method 12 will include, for each hairstyle 602, 604, 606, defining the hairstyling steps and tools to implement that particular hairstyle.

In another aspect, the invention includes a system of hairstyling tools according to the systematizing method 12 as well as the individual tools of that system. In another aspect, the invention includes one or more sets of hairstyling tools selected for use to create a specific hairstyle and packaged or otherwise sold together. Example embodiments of this aspect of the invention include the packages 802, 804, 806 of the hairstyling tool sets 702, 704, 706 described herein.

It is to be understood that this invention is not limited to the specific systems, methods, conditions, or parameters described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A method of systematizing hairstyling tools, comprising:

a) defining a plurality of hairstyles for a plurality of hair types, wherein each of the hairstyles is associated with at least one of the hair types;

b) defining a series of sequential hairstyling steps in a multi-step hairstyling regimen to implement each of the hairstyles, wherein each of the hairstyling steps includes the use of at least one of the hair-styling tools;

c) determining which of the hairstyling tools are suitable for performing each of the defined hairstyling steps;

d) pre-packaging a plurality of hairstyling tool sets, one for each of the plurality of hairstyles, each of the hairstyling tools in each set selected for performing one of the sequential hairstyling steps to implement one of the plurality of hairstyles;

e) defining indicia relating to each of the hairstyling steps, wherein the indicia include numerically sequential indicia, step-descriptive indicia, or a combination thereof, each of the hairstyling tools having associated therewith indicia corresponding to its hairstyling step; and f) displaying the indicia for the hairstyling steps in connection with the advertising and sale of the corresponding hairstyling tool sets, including displaying the indicia on the hairstyling tools, on tags attached to the hairstyling tools, on packaging for the sets of hairstyling tools, or on a combination thereof.

2. The method of claim 1, wherein one of the hairstyling steps of method step (b) includes detangling and drying; curling, straightening, adding volume and body, or a combination thereof; or smoothening and adding shine.

3. The method of claim 1, further comprising the step of defining written instructions for implementing each of the hairstyling steps and displaying the written instructions in connection with the advertising and sale of the corresponding sets of hairstyling tools.

4. The method of claim 1, wherein method step (a) includes defining first, second, and third hairstyles.

5. The method of claim 4, wherein the first hairstyle is volume and straight for medium to long length hair or layered bobs; the second hairstyle is volume and curl for all length hair; and the third hairstyle is volume and smooth for medium to long length hair, brittle hair, or dry hair.

6. The method of claim 1, wherein one of the hairstyles is volume and straight for medium to long length hair or layered bobs; volume and curl for all length hair; or volume and smooth for medium to long length hair, brittle hair, or dry hair.

7. The method of claim 1, wherein method step (b) includes defining first, second, and third hairstyling steps.

8. The method of claim 7, wherein the first hairstyling step includes detangling and drying, the second hairstyling step includes curling, straightening, adding volume and body, or a combination thereof, and the third hairstyling step includes smoothening and adding shine.

9. The method of claim 7, further comprising the step of selecting three hairstyling tools each for performing one of the three hairstyling steps to implement one of the hairstyles, each of the three hairstyling tools having associated therewith indicia corresponding to its hairstyling step, the selected three hairstyling tools pre-packaged together in one of the hairstyling tool sets.

10. A method of systematizing hairstyling tools, comprising:

a) defining first, second, and third hairstyles for first, second, and third hair types, respectively, wherein the first hairstyle is volume and straight for medium to long length hair or layered bobs; the second hairstyle is volume and curl for all length hair; and the third hairstyle is volume and smooth for medium to long length hair, brittle hair, or dry hair;

b) defining first, second, and third sequential hairstyling steps in a multi-step hairstyling regimen to implement each of the hairstyles, wherein each of the hairstyling steps includes the use of at least one of the hairstyling tools, wherein the first hairstyling step includes detangling and drying, the second hairstyling step includes curling, straightening, adding volume and body, or a combination thereof, and the third hairstyling step includes smoothening and adding shine;

c) determining which of the hairstyling tools are suitable for performing each of the defined hairstyling steps;

d) pre-packaging hairstyling tools together in first, second, and third sets of hairstyling tools, each of the hairstyling tools of each set selected for performing one of the sequential hairstyling steps to implement a respective one of the first, second, or third hairstyles;

e) defining indicia corresponding to each of the hairstyling steps, wherein the indicia include numerically sequential indicia, step-descriptive indicia, or a combination thereof, each of the hairstyling tools of each set of hairstyling tools having associated therewith indicia corresponding to its hairstyling step; and f) displaying the indicia for the hairstyling steps in connection with the advertising and sale of the corresponding sets of hairstyling tools, including displaying the indicia on the hairstyling tools, on tags attached to the hairstyling tools, on packaging for the sets of hairstyling tools, or on a combination thereof.

11. The method of claim 10, wherein the first, second, and third sets of hairstyling tools each comprises three hairstyling tools selected for performing one of the three hairstyling steps to implement one of the three hairstyles, each of the hairstyling tools of each set having associated therewith indicia corresponding to its hairstyling step.

12. The method of claim 10, further comprising the steps of defining written instructions for implementing each of the hairstyling steps and displaying the written instructions in connection with the advertising and sale of the corresponding sets of hairstyling tools.

* * * * *